US005558451A

United States Patent [19]

Hanabusa et al.

[11] Patent Number: 5,558,451

[45] Date of Patent: Sep. 24, 1996

[54] SHIFTABLE GUIDE MEMBER WITH ROLLERS IN A SHEET FEEDING APPARATUS

[75] Inventors: Tadashi Hanabusa; Masanori Kaneko, both of Kawasaki; Koh Hasegawa, Yokohama, all of Japan

[73] Assignee: Canon Kabushiki Kaisha, Tokyo, Japan

[21] Appl. No.: 203,746

[22] Filed: Mar. 1, 1994

Related U.S. Application Data

[63] Continuation of Ser. No. 956,475, Oct. 2, 1992, abandoned, which is a continuation of Ser. No. 634,735, Dec. 27, 1990, abandoned.

[30] Foreign Application Priority Data

Dec. 29, 1989 [JP] Japan ..... 1-344905

[51] Int. Cl.[6] ..... B41J 13/054

[52] U.S. Cl. ..... 400/637; 400/636.3; 400/637.2

[58] Field of Search ..... 400/637, 636, 400/636.3, 637.3, 637.5, 642, 637.6, 645.3, 645.4, 638, 639.1, 639.2, 649, 902; 271/261, 259, 265, 266, 272, 3, 314, 264, 900, 9; 354/301; 270/1.1, 52; 355/104, 108

[56] References Cited

U.S. PATENT DOCUMENTS

| | | | |
|---|---|---|---|
| 2,236,589 | 4/1941 | Anderson | 400/638 X |
| 2,978,088 | 4/1961 | Pearson | 400/636.3 X |
| 4,708,504 | 11/1987 | Asakura | 400/637 |
| 4,729,557 | 3/1988 | Kiyohara | 271/272 |
| 4,772,898 | 9/1988 | Noda | 346/136 |
| 4,786,193 | 11/1988 | Quinn | 400/636.3 |
| 4,881,089 | 11/1989 | Saito | 346/140 R |
| 4,900,173 | 2/1990 | Okamura | 400/606 |
| 4,961,658 | 10/1990 | Takagi | 400/636.1 |

FOREIGN PATENT DOCUMENTS

| | | | |
|---|---|---|---|
| 834409 | 7/1949 | Germany | 400/636.3 |
| 2603529 | 8/1976 | Germany | 400/636.2 |
| 80090 | 5/1982 | Japan | 400/636.3 |
| 148082 | 7/1986 | Japan | 400/636.2 |
| 231778 | 10/1987 | Japan | 400/637 |

OTHER PUBLICATIONS

"Automatic Impression Control"; Xerox Tech. Disclosure Bulletin, vol. 1, No. 7, Jul. 1976.

*Primary Examiner*—David A. Wiecking

*Attorney, Agent, or Firm*—Fitzpatrick, Cella, Harper & Scinto

[57] ABSTRACT

The present invention provides a sheet feeding apparatus, comprising a conveying rotary member for conveying a sheet by rotating while contacting the sheet, an urging member for urging the sheet against the conveying rotary member, and a supporting means for supporting the urging member for movement in a sheet conveying direction.

7 Claims, 30 Drawing Sheets

HOME POSITION SWITCH
ON
OFF
CAP 51
ON
OFF
PUMP 53
UPPER DEAD POINT
LOWER DEAD POINT
BLADE 59
ON
OFF
0
90
180
270
360
0
4.5
135
300
A
B
C
D
E
F
36.6
54.1
4.3
4.0
145
168.5
250.3
295.0
193.4
5.0
109.5
130.5
155
185
209.5
230.5
290
259.2
295
305
356.1
IDLE SUCTION
VALVE FULL CLOSE POINT
VALVE CLOSE POINT
VALVE FULL OPEN POINT
VALVE OPEN POINT

SHIFTABLE GUIDE MEMBER WITH ROLLERS IN A SHEET FEEDING APPARATUS

This application is a continuation of application Ser. No. 07/956,475 filed Oct. 2, 1992, which in turn is a continuation of application Ser. No. 07/634,735 filed Dec. 27, 1990, both now abandoned.

BACKGROUND OF THE INVENTION

1. Field of the Invention

The present invention relates to a sheet feeding apparatus, and more particularly, it relates to a sheet feeding apparatus used with an ink jet recording system.

2. Related Background Art

In the past, recording systems which can record an image on a recording medium (referred to as "recording sheet" or merely "sheet" hereinafter) such as a paper or an OHP sheet have been proposed to include a recording head of various types. Such recording heads are of wire dot type, heat-sensitive type, heat-transfer type or ink jet type.

Among these recording system, particularly, the ink jet recording system is of the type that the ink is directly ejected or discharged onto the recording sheet and is being regarded as a recording system having the advantages that the running cost thereof is cheap and the operation thereof is noiseless.

Further, in the recent ink jet recording system, particularly, the recording head thereof has been manufactured by the film forming technique or micro-working technique in the semiconductor device. Thus, it has been realized as more compact and cheaper. Consequently, for example, a disposable or non-returnable recording head having an integral ink tank has also been proposed, so that the recording system itself becomes compact and simple.

On the other hand, the ink jet recording system having the above-mentioned various advantages has been widely used as recording means of various apparatuses such as a electronic typewriter, word processor, facsimile, copying machine and the like. In this case, the ink jet recording system has the construction corresponding to the function and usage inherent to such apparatuses.

Further, the electronic typewriter, word processor and the like have a tendency to be small-sized, light-weighted and portable; in this respect, it is required that the ink jet recording system used with these apparatuses be compact and simple.

The above-mentioned tendency regarding the recent ink jet recording system, i.e., the compactness and simplification require the simplification of the elements constituting the ink jet recording system and the simplification of the mechanisms connecting these elements.

Among these elements and mechanisms, a mechanism for feeding the recording sheet requires a relatively large space for installation thereof in the recording system, and, accordingly, by simplifying this mechanism, the effective compactness and simplification of the system can be achieved. Particularly, in this feeding mechanism, a biasing means pressed against means for feeding the recording sheet such as conveying rollers, ejector rollers and the like, for providing a conveying force (friction force) between such feeding means and the recording sheet is a main part of the feeding mechanism. The biasing means is embodied as a pressure roller and a paper hold-down plate urging the conveying roller, or a spur urging the ejector roller.

On the other hand, the recording sheet feeding mechanism in the electronic typewriter must have a construction corresponding to various recording sheets such as a plain paper, envelope and the like. In particular, it must have a construction corresponding to the thickness of the recording sheet.

Above all, the paper hold-down plate has not only a function for causing the conveying roller to generate the conveying force and but also a function for regulating the feeding direction of the conveying roller to properly maintain a distance between the recording head and the recording sheet. Thus, in order to demonstrate such functions effectively, the paper hold-down plate and associated mechanisms, and the material forming these elements must correspond to the recording sheet.

Further, when a relatively thicker recording sheet such as an envelope is conveyed, there arises a problem that the discrepancy between, for example, the conveying roller and the pressure roller occurs during the conveyance of the recording sheet, thus causing the positional discrepancy in the recording position on the recording sheet.

Such positional discrepancy will occur when a trailing end of a relatively thicker recording sheet passes through a nip between the conveying roller and the pressure roller. That is to say, when the thicker recording sheet is being conveyed, the pressure roller biased to be urged against the conveying roller is spaced apart from the conveying roller by a distance corresponding to the thickness of the recording sheet. However, when the trailing end of the recording sheet has just passed through the nip, the pressure roller approaches the conveying roller, thus pushing the trailing end of the recording sheet in a recording sheet conveying direction, with the result that the conveying roller is excessively rotated by an amount corresponding to the backlash between gears in a drive/transmission mechanism.

SUMMARY OF THE INVENTION

An object of the present invention is to prevent the positional discrepancy of the recording sheet caused by pushing a trailing end of the recording sheet in a recording sheet conveying direction by means of a pressure roller immediately after the recording sheet has just passed through a nip between a conveying roller and the pressure roller urged thereagainst.

In order to achieve the above object, according to the present invention, there is provided a recording system for recording an image on a recording sheet while conveying the latter, comprising a conveying roller for conveying the recording sheet by the rotation thereof, a pressure roller for urging the recording sheet against the conveying roller, and a supporting means for supporting the pressure roller in such a manner that the pressure roller can be shifted in a recording sheet conveying direction.

BRIEF DESCRIPTION OF THE DRAWINGS

FIG. 21 is a timing chart of a recording position command mode in the recording system shown in FIG. 2 and the like;

DETAILED DESCRIPTION OF THE PREFERRED EMBODIMENTS

The present invention will now be explained in connection with embodiments thereof with reference to the accompanying drawings.

Figure 1A:
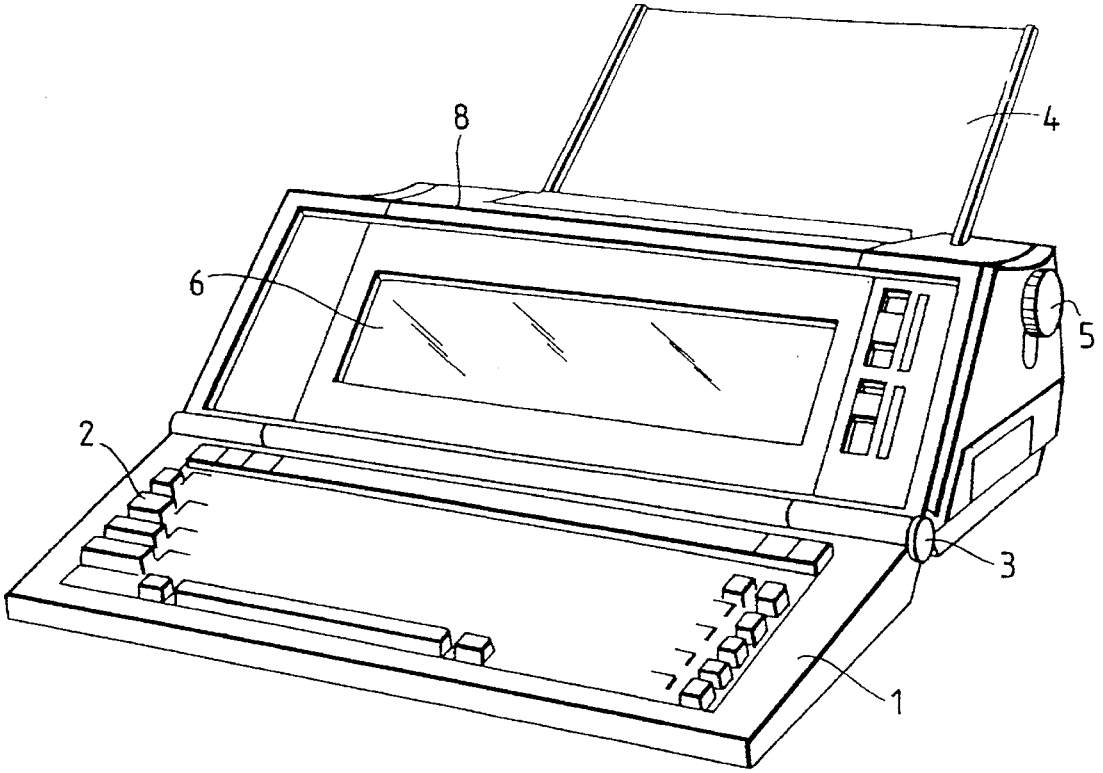
FIGS. 1A and 1B are perspective views of an electronic typewriter according to a preferred embodiment of the present invention, in operational and non-operational configurations, respectively.
Figure 1B:
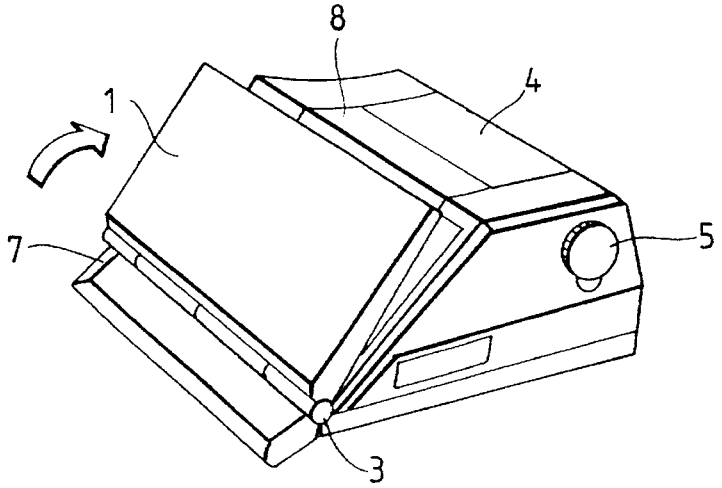

FIGS. 1A and 1B show an outer appearance of an electronic typewriter to which the present invention is applicable.

The reference numeral 1 denotes a keyboard portion including a plurality of keys 2, such as character inputting keys, numerical keys and the like, control keys and the like. The keyboard portion 1 can be folded up by rotating it around a hinge 3 in the non-operational configurations, thereof, as shown in FIG. 1B. The reference numeral 4 denotes a sheet supply tray for supplying a recording sheet to a printer portion disposed in the typewriter. This tray can also be folded up to cover the printer portion in the non-operational configurations, thereof, as shown in FIG. 1B. The reference numeral 5 denotes a knob for manually setting and ejecting the recording sheet; 6 denotes a display for displaying a sentence or sentences inputted; and 7 denotes a grip used in the transportation of the typewriter.

The reference numeral 8 denotes a transparent window constituting a cover for the electronic typewriter and disposed at the top of the typewriter adjacent to the display 6, so that an operator can observe the ink jet printer and the recording sheet housed in the typewriter as described later.

Figure 2:
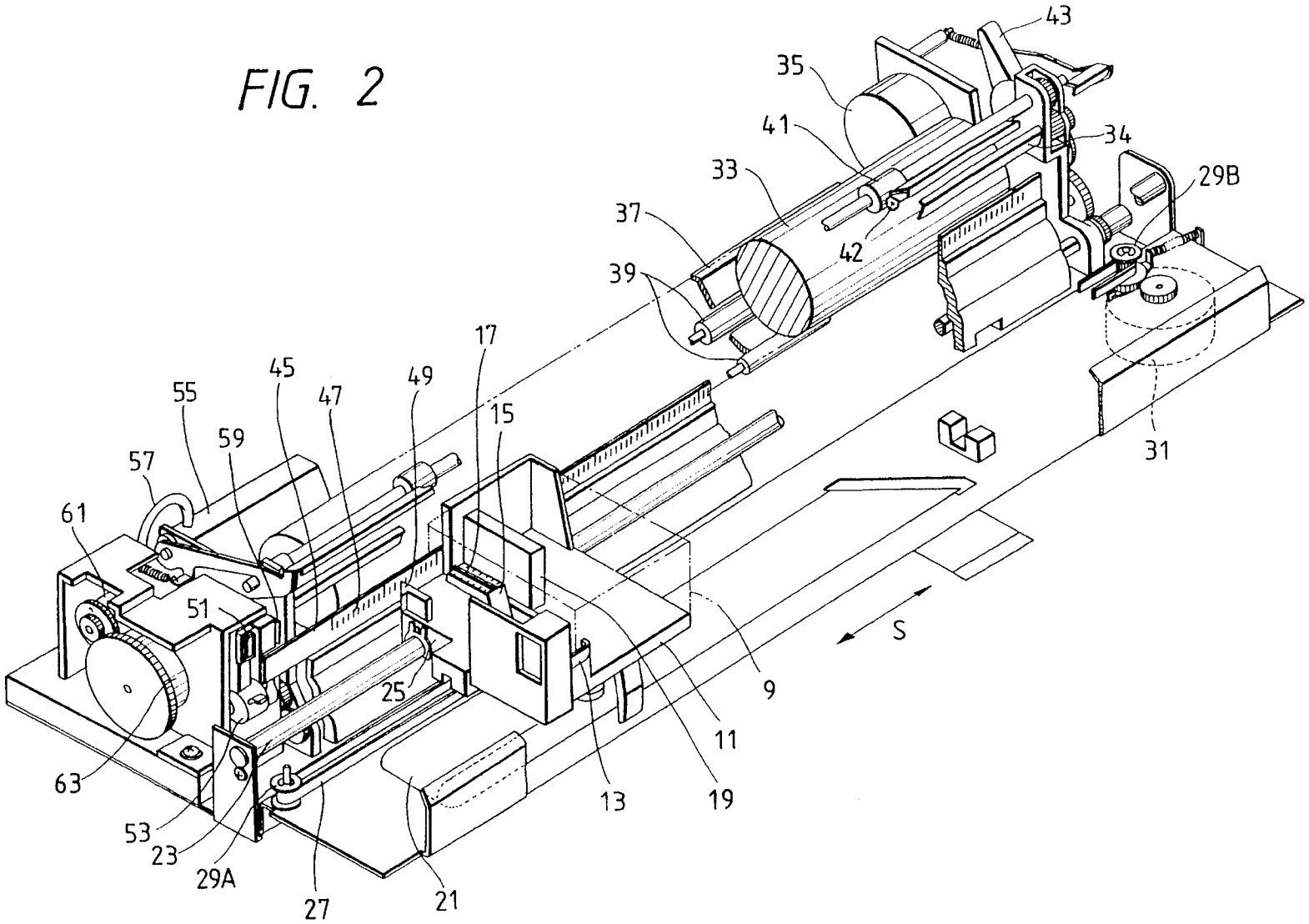
FIG. 2 is a perspective view showing an example of the construction of a printer applicable to the present invention.

FIG. 2 shows an example of the construction of the printer portion according to this embodiment.

The reference numeral 9 denotes a head cartridge having an ink jet recording head which will be fully described later with reference to FIGS. 3 and 4; and 11 denotes a carriage for mounting the cartridge thereon and performing a scanning operation in a direction S shown in FIG. 2. The reference numeral 13 denotes a hook for attaching the head cartridge 9 to the carriage 11; and 15 denotes a lever for manipulating the hook 13. The lever 15 has a marker 17 capable of reading a printing position and a set position of the recording head of the head cartridge by cooperating with a scale provided on a cover which will be described later. The reference numeral 19 denotes a supporting plate for supporting an electric connector portion to the head cartridge 9; and 21 denotes a flexible cable for connecting the electric connector portion to a controlling portion of the typewriter.

The reference numeral 23 denotes a guide shaft for guiding the carriage 11 in the direction S, which shaft is received in bearings 25 disposed in the carriage 11. The reference numeral 27 denotes a timing belt to which the carriage 11 is fixed and adapted to transmit a power for shifting the carriage. The timing belt extends between and is supported by pulleys 29A and 29B arranged on both sides of the typewriter, with an appropriate tension. A driving force from a carriage motor 31 is transmitted to the pulley 29B through any transmission mechanism such as gears.

The reference numeral 33 denotes a conveying roller for regulating a recorded surface (surface to be recorded) of a recording medium (referred to as "recording sheet" or "sheet" hereinafter) and for conveying the recording sheet for the recording operation. The conveying roller 33 is driven by a conveying motor 35. The reference numeral 37 denotes a paper pan for directing the recording sheet from the supply tray 4 to a recording position; and 39 denotes a feed roller arranged in a feeding path, for urging the recording sheet toward the conveying roller 33 to convey the recording sheet.

The reference numeral 34 denotes a platen disposed in confronting relation to discharge openings of the head cartridge 9 and adapted to regulate the recorded surface of the recording sheet. The reference numeral 41 denotes an ejector roller arranged at a downstream side of the recording position in a recording sheet feeding or conveying direction and adapted to eject the recording sheet toward an ejecting opening (not shown). The reference numeral 42 denotes a spur arranged in correspondence with the ejector roller 41 and urging the roller 41 with the interposition of the recording sheet, thus creating a conveying force of the ejector roller 41 for the recording sheet. The reference numeral 43 denotes a release lever for releasing the biasing of the feed roller 39, hold-down plate 45 and spur 42 during the setting of the recording sheet and the like.

The reference numeral 45 denotes the above-mentioned hold-down plate for suppressing the floating of the recording sheet in the vicinity of the recording position to maintain the close contact between the recording sheet and the conveying roller 33. In the illustrated embodiment, an ink jet recording head is provided for performing the recording by discharging ink as the recording head. Accordingly, since a distance between a surface on which the discharge openings are formed and the recorded surface of the recording sheet is relatively short, and such distance must be strictly controlled to prevent contact between the recording sheet and the discharge opening forming surface, provision of the hold-down plate is effective. The reference numeral 47 denotes a scale formed on the hold-down plate 45; and 49 denotes a marker on the carriage 11 formed in correspondence to the scale 47. The scale 47 and the marker 49 cooperate with each other to permit the readings of the printing position and the set position.

The reference numeral 51 denotes a cap made of elastic material such as rubber and disposed in confronting relation to the discharge opening forming surface of the recording head and supported for movement to contact with and separate from the recording head. The cap 51 serves to protect the recording head in its non-operational configuration and is used in the discharge recover treatment for the recording head. The discharge recover treatment is a treatment that the cap 51 is positioned to face the discharge opening forming surface and then the ink is discharged from all of the discharge openings by energizing energy generating elements disposed in the discharge openings and used for discharging the ink, thus removing bubbles, dusts and/or viscous improper ink from the discharge openings to eliminate the poor ink discharging factors, or a treatment that the poor ink discharging factors are eliminated by positively discharging the ink from the discharge openings with the discharge opening forming surface covered by the cap 51.

The reference numeral 53 denotes a pump used for providing a suction force to effect the positive ink discharge and for sucking the ink collected in the cap 51 by the positive discharge recover treatment and/or preliminary discharge recover treatment. The reference numeral 55 denotes a waste ink tank for storing the waste ink sucked by the pump 53; and 57 denotes a tube for connecting between the pump 53 and the waste ink tank 55.

The reference numeral 59 denotes a blade adapted to wipe the discharge opening forming surface of the recording head, and is supported for movement between an operating position where it protrudes toward the recording head to wipe the head being moved, and a retracted position where it is separated from the discharge opening forming surface. The reference numeral 61 denotes a motor; and 63 denotes a cam mechanism which can receive the power from the motor 61 to activate the pump 53 and to shift the cap 51 and blade 59.

Figure 3:
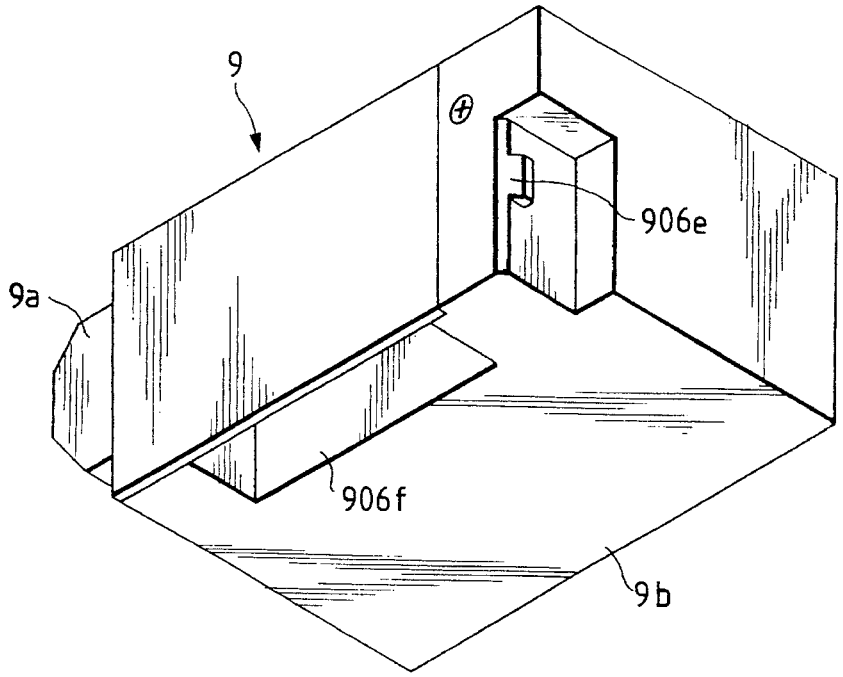
FIG. 3 is a perspective view of a head cartridge shown in FIG. 2.

FIG. 3 shows an outer appearance of the head cartridge 9 constituted by integrally forming an ink tank **9*b* and a discharge unit 9*a* providing a body of the ink jet recording head. In FIG. 3, the reference numeral 906*e* denotes a pawl engaged by the hook 13 of the carriage 11 when the head cartridge 9 is mounted on the carriage. As is apparent from FIG. 3, the pawl 906*e* is arranged inside of the whole length of the recording head. Further, a positioning pad or abutment (not shown in FIG. 3) is formed in the vicinity of the front discharge unit 9*a* of the head cartridge 9. The reference numeral 906*f* denotes a head aperture into which the supporting plate 19 uprightly formed on the carriage 11** and supporting a flexible substrate (electric connector portion) and a rubber pad is inserted.

Figure 4B:
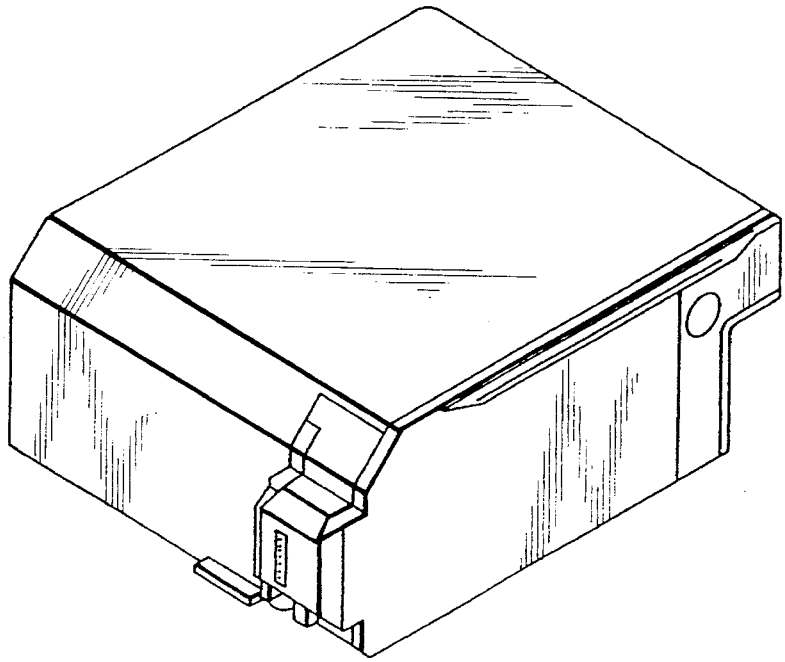
FIGS. 4A and 4B are an exploded perspective view and an outer appearance perspective view of the head cartridge shown in FIG. 3, respectively.
Figure 4A:
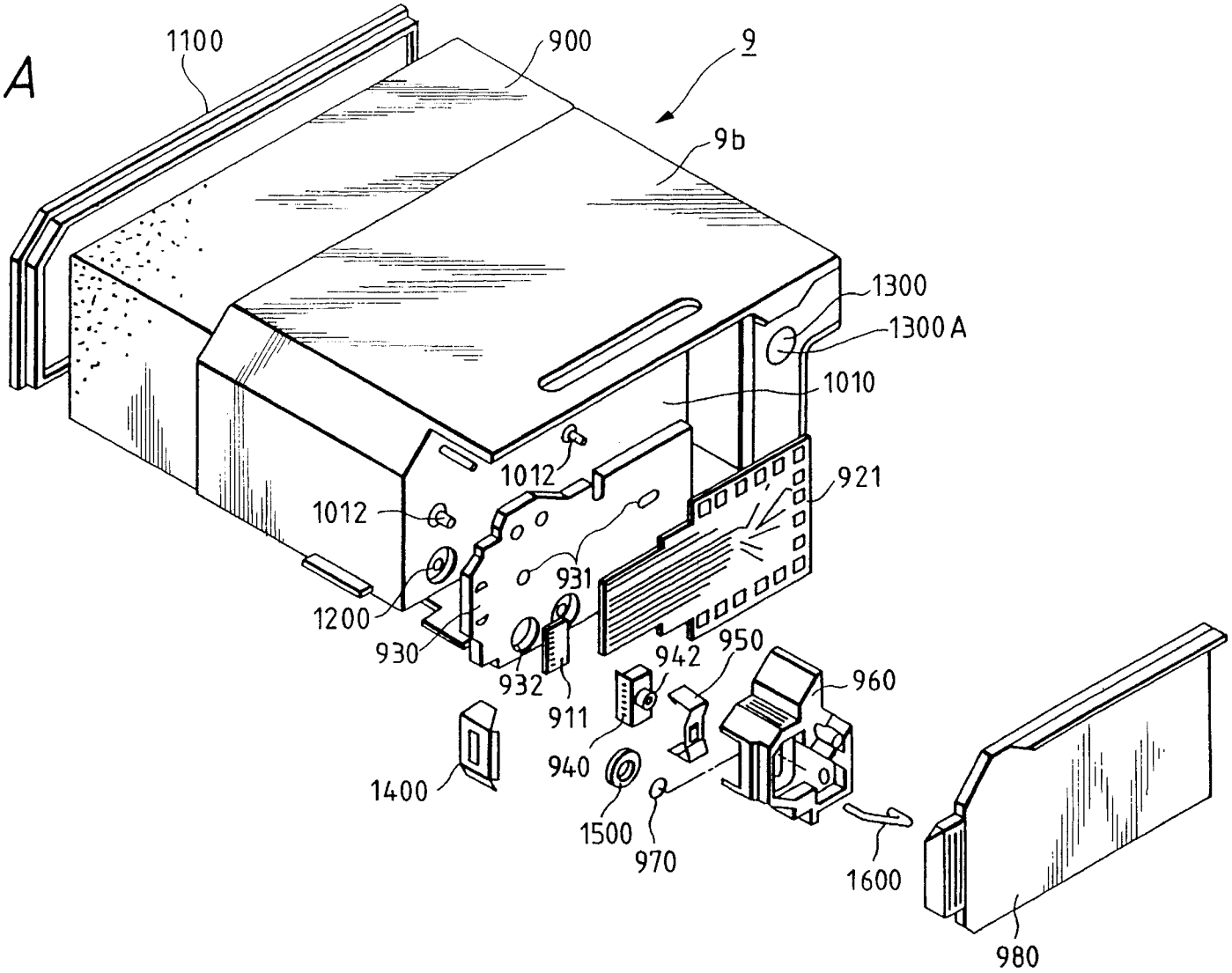

FIGS. 4A and 4B show an exploded perspective view and an assembled perspective view of the head cartridge shown in FIG. 3, respectively, which head cartridge is of the disposable type integrally incorporating an ink containing portion acting as an ink supply source, as mentioned above.

In FIG. 4A, the reference numeral 911 denotes a heater board constituted by forming electrical/thermal converting elements (discharge heaters) and wirings made of aluminium and the like for supplying the electric power to the discharge heaters on a silicon substrate by the film forming technique. The reference numeral 921 denotes a wiring substrate for the heater board 911, and corresponding wirings are connected to each other by wire bonding, for example.

The reference numeral 940 denotes a top plate including partition walls for defining ink paths and a common liquid chamber, which top plate is made of resin material integrally including a orifice plate portion in this embodiment.

The reference numeral 930 denotes a support made of metal, for example; and 950 denotes a hold-down spring. By engaging the support 930 and the hold-down spring 950 with the interposition of the heater board 911 and the top plate 940, these elements 911, 940 are fixedly held by the urging force of the hold-down spring 950. Incidentally, the support 930 can include a positioning reference for positioning the cartridge on the carriage 11 performing the scanning operation of the recording head, and the wiring substrate 921 may be fixed to the support by adhesive and the like. Further, the support 930 also serves as a radiating member for radiating the heat generated by the activation of the heater board 911.

The reference numeral 960 denotes a supply tank which receives the ink from the ink supply source, i.e., ink tank (ink reservoir) **9*b* and directs the ink to the common liquid chamber defined between the heater board 911 and the top plate 940 when they are engaged by each other. The reference numeral 970 denotes a filter disposed near an ink supply opening of the supply tank 960 communicating with the common liquid chamber; and 980 denotes a lid member for the supply tank 960**.

The reference numeral 900 denotes an ink absorber disposed in the ink tank 9*b* for impregnating the ink therein. The reference numeral 1200 denotes an ink supply opening for supplying the ink to the discharge unit or recording element 9*a* comprising the above members 911–980. The ink can be impregnated in the ink absorber 900 by pouring the ink from the supply opening 1200 before the discharge unit 9*a* is installed in a portion 1010 of the ink tank 9*b*.

The reference numeral 1100 denotes a lid member for the head cartridge; and 1300 denotes a vent opening formed in the lid member 1100 for communicating the interior of the cartridge with the atmosphere. The reference numeral 1300A denotes a liquid repelling member disposed in the vent opening 1300 for preventing the leakage of the ink from the vent opening 1300.

After the filling of the ink to the ink tank 9*b* through the supply opening 1200 is completed, the discharge unit 9*a* comprising the members 911–980 is installed in the portion 1010 of the ink tank. In this case, the positioning and fixing of the discharge unit regarding the ink tank can be effected, for example, by fitting projections 1012 formed on the ink tank 9*b* into corresponding holes 931 formed in the support 930. In this way, the head cartridge 9 is assembled, as shown in FIG. 4B.

Consequently, the ink is supplied from the ink tank to the supply tank 960 through the supply opening 1200, a hole 932 formed in the support 930 and an introduction opening (not shown) formed in the back surface (FIG. 4A) of the supply tank 960, and then flows through the supply tank 960 and flows from an outlet opening (not shown) of the supply tank into the common liquid chamber through an appropriate supply tube and an ink introduction opening 942 formed in the top plate 940.

In the above ink supply path, packings made of silicone rubber, butyl rubber and the like, for example, are disposed at connecting portions between various elements, thus providing the sealed ink supply path.

Figure 5A:
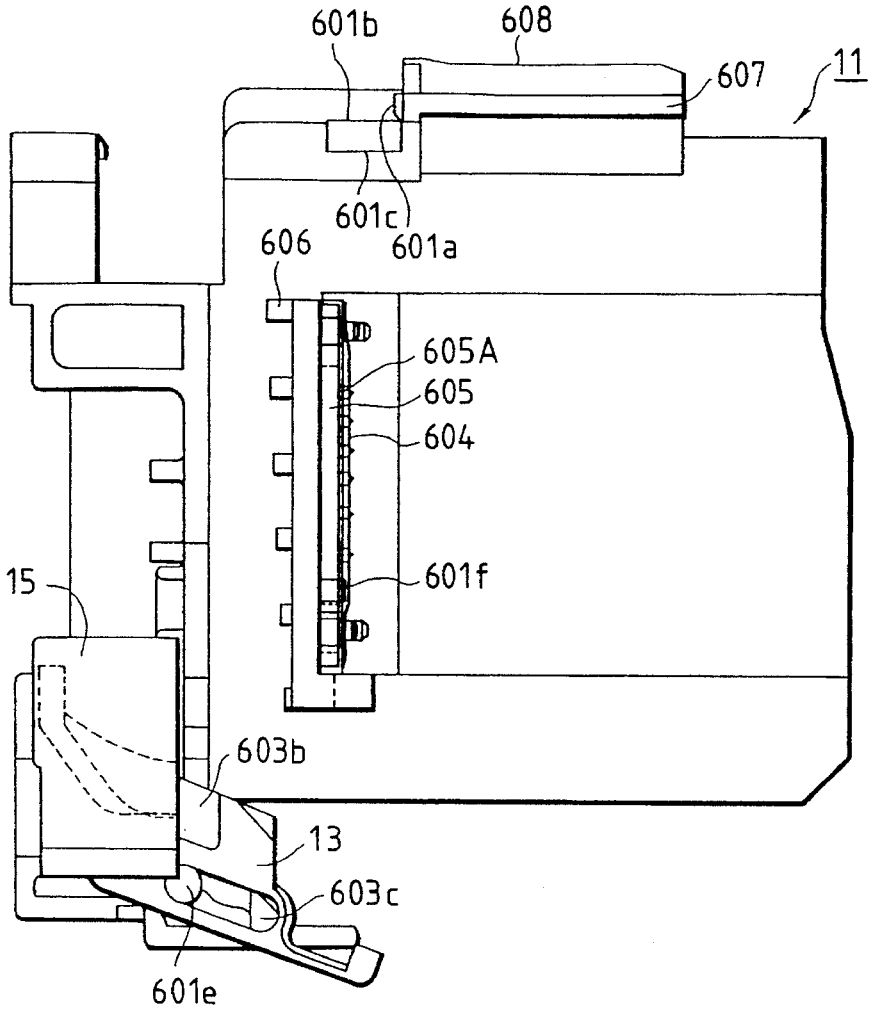
FIGS. 5A and 5B are a plan view and a side view of a carriage shown in FIG. 2, respectively.
Figure 5B:
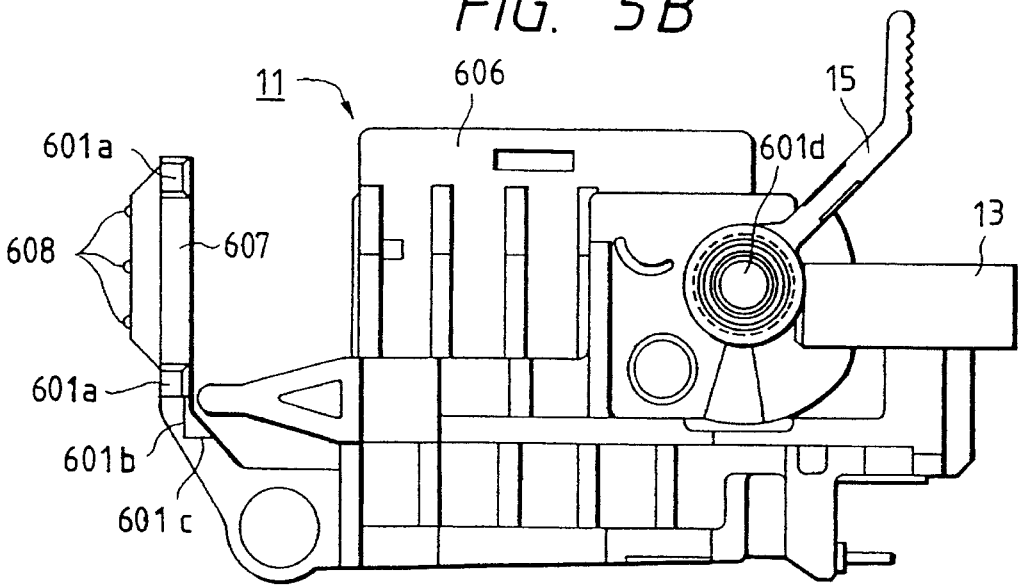

FIGS. 5A and 5B are a plan view and a right side view showing the details of the carriage 11, respectively.

In FIGS. 5A and 5B, the reference numeral 606 denotes supporting plates uprightly formed on the bottom of the carriage 11 and supporting a flexible substrate 604 and a rubber pad 605 having projections 605A corresponding to terminal pads formed on the flexible substrate 604.

The reference numeral 607 denotes an abutment uprightly formed on the bottom of the carriage 11 at a front part thereof. The abutment 607 has a thin wall, so as to make the space for the ink tank larger as long as possible within the limited installation space for the head cartridge 9 and the carriage 11. To this end, the abutment 607 has three ribs 608 for reinforcing it. The ribs 608 extend in a shifting direction of the carriage 11 so that the abutment can have the strength capable of enduring the turning movement caused in the mounting and dismounting operation of the head cartridge. Further, the ribs 608 are so designed that they protrude forwardly from the discharge opening forming surface of the head cartridge 9 by about 0.1 mm when the head cartridge is mounted on the carriage. Consequently, even if the recording sheet protrudes in the shifting path of the recording head for some reasons, the recording sheet can be prevented from rubbing the discharge opening forming surface.

The operating lever 15 for effecting the mounting and dismounting operation for the head cartridge is rotatably supported on a shaft 601*d* mounted on the carriage 11. The hook 13 is used for performing the mounting and dismounting of the head cartridge 9, by shifting the head cartridge engaged by this hook through the movement of the hook caused by the movement of the operating lever 15 engaged by the hook. The hook 13 can move for the above-mentioned mounting and dismounting of the head cartridge by guiding a slot 603*c* formed in the hook on a guide shaft.

Since the mounting and dismounting operation mechanism comprising the operating lever 15, hook 13 and the like is disposed at a side of the carriage 11, i.e., at a side of the carriage shifting direction, the mounting and dismounting operation mechanism does not generate a large dead space by the shifting of the carriage.

Next, the abutment for positioning the head cartridge during the mounting of the latter on the carriage will be explained.

The reference numeral 601*a* denotes two abutment portions for positioning the cartridge in the left-and-right direction, which abutment portions are disposed on both sides of the abutment member 607. Incidentally, in the positioning of the cartridge in the left-and-right direction, an abutment portion 601*f* formed on the supporting plate 606 is also used, as well as the abutment portions 601*a*.

The reference numeral 601*b* denotes an abutment portion for positioning the cartridge in the front-and-rear direction, which abutment portion is disposed at a side of the abutment member 607 at a lower part thereof. The reference numeral 601*c* denotes two abutment portions for positioning the cartridge in the up-and-down direction, which abutment portions are disposed at a lower side part of the abutment member 607 and at a lower side part of the supporting plate, respectively.

Figure 6A:
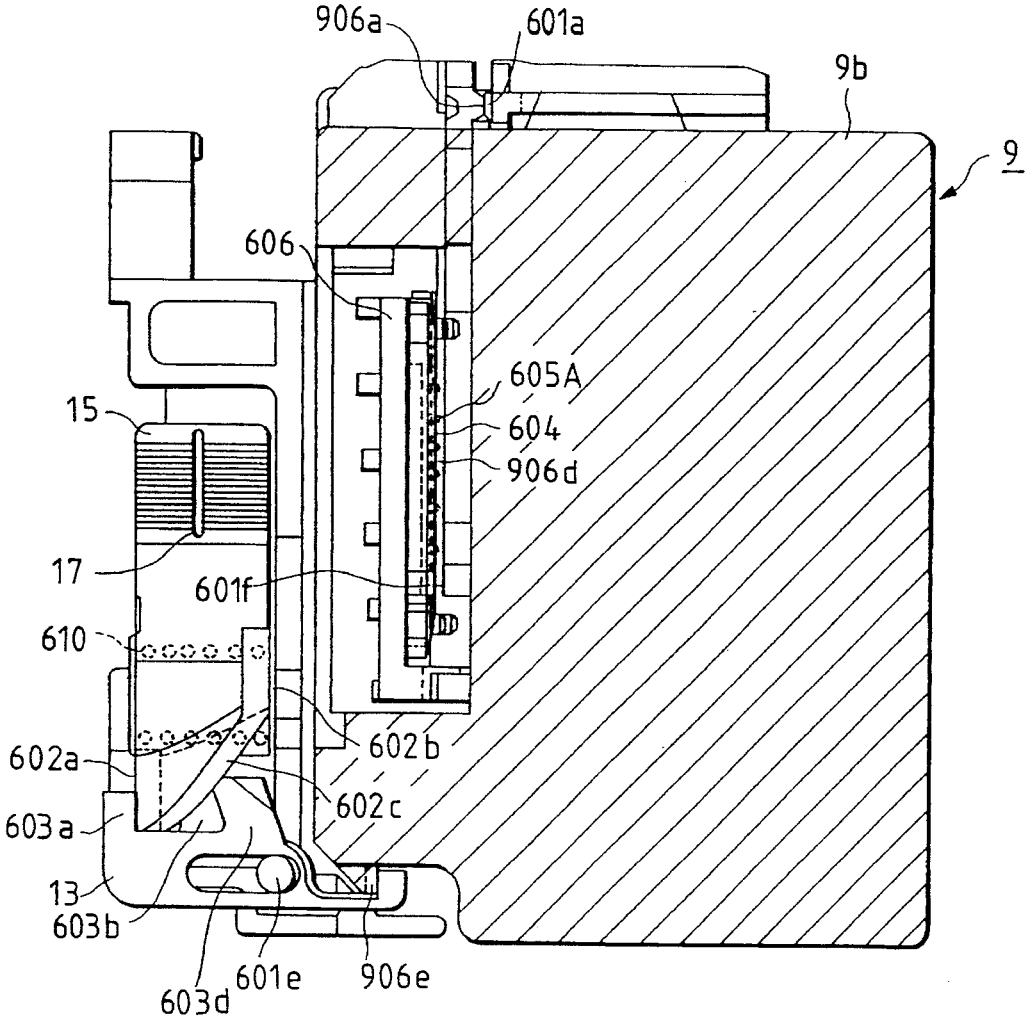
FIGS. 6A and 6B are a plan view and a side view showing a condition that the head cartridge is mounted on the carriage, respectively.
Figure 6B:
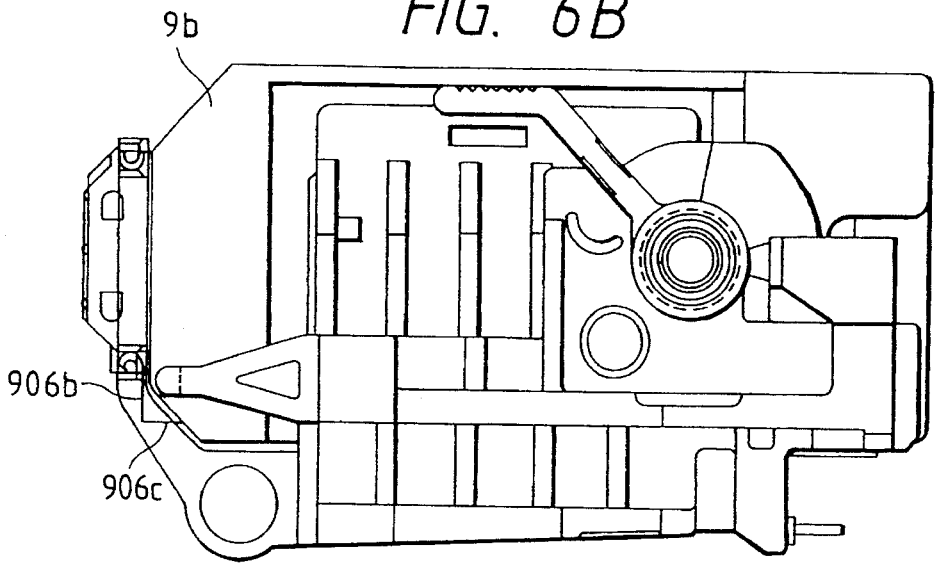

FIGS. 6A and 6B are a plan view and a left side view showing a condition that the head cartridge 11 is mounted on the carriage 9, respectively.

In FIGS. 6A and 6B, the reference numeral 906*a* denotes abutment portions which can be abutted against the abutment portions 601*a* of the carriage 11 when the recording head is mounted; and 906*b* and 906*c* denote abutment portions corresponding to the abutment portions 601*b* and 601*c*, respectively.

Next, the engagement relation between various elements when the recording head is mounted will be explained with reference to FIG. 6A.

The abutment portions 906*a* of the head cartridge 9 are abutted against the abutment portions 601*a* of the carriage 9, and at the same time, the pawl 906*e* of the head cartridge 9 is biased in the left direction (FIG. 6A) by a coil spring 610 through the hook 13 engaged by the pawl. Consequently, the head cartridge 9 is subjected to a moment force around the abutment portions. In this case, a substrate 906*d* arranged on the head is abutted against the abutment portion 601*f*, with the result that the head cartridge 9 is positioned in the left-and-right direction, thus keeping the cartridge in that position.

In this case, the projections 605A of the rubber pad 605 is compressed and deformed by the abutment between them and the substrate 906*d*. Due to this deformation, there arises an urging force for urging the terminal pads of the flexible substrate 604 against terminals of the substrate 906*d*. In this case, since the substrate 906*d* is abutted against the abutment portion 601*f*, the deforming amount of the projections 605A becomes uniform or constant, thus providing a stable urging force.

Incidentally, in FIG. 6A, the condition that the projections 605A are deformed is not shown. Further, the positioning of the head cartridge 9 in the front-and-rear direction and in the up-and-down direction is effected during the mounting of the head cartridge on the carriage.

Figure 7A:
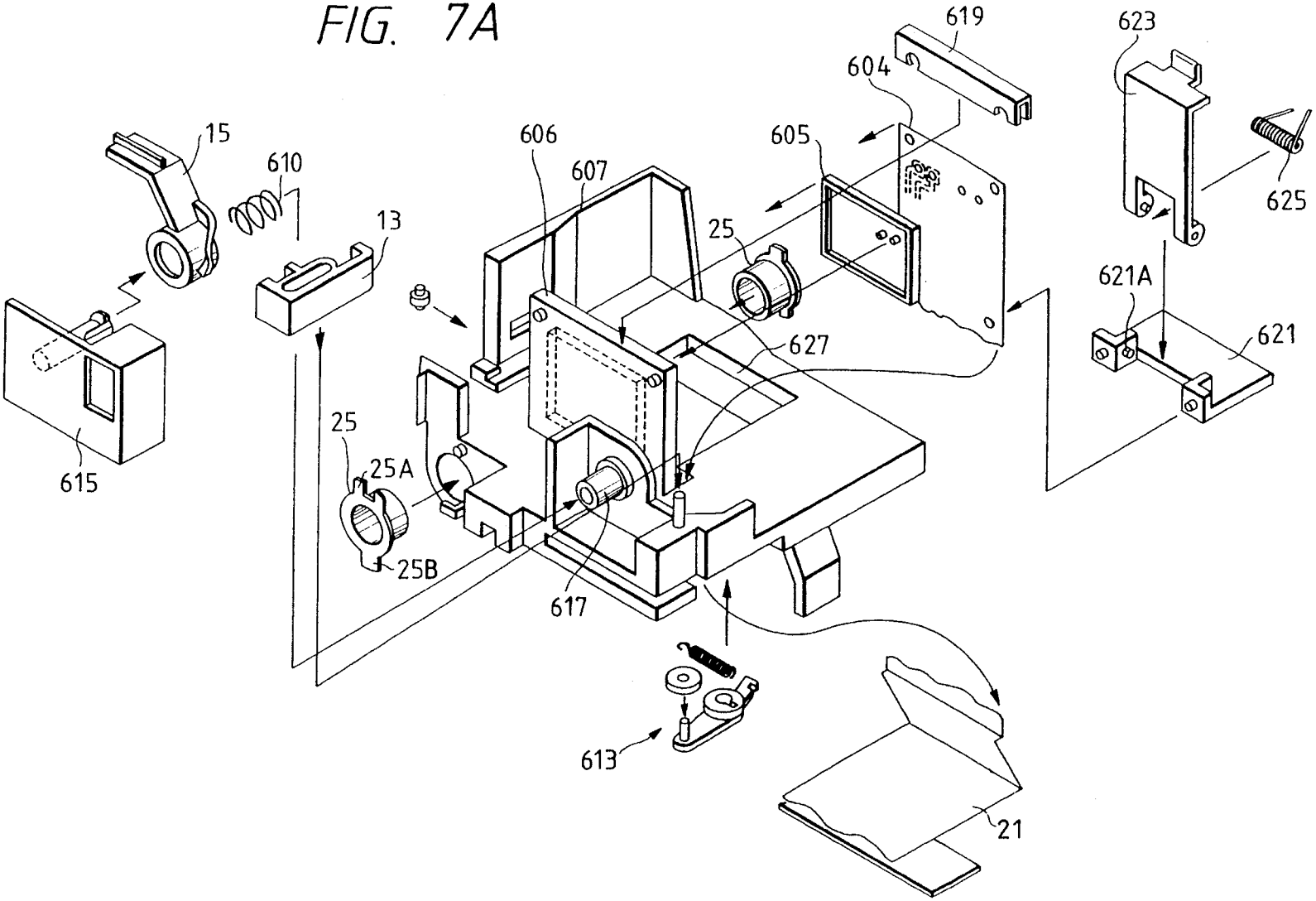
FIGS. 7A and 7B are an exploded perspective view and a side view of the carriage, respectively.

FIG. 7A shows an exploded perspective view of the carriage 11.

In FIG. 7A, the reference numeral 613 denotes a spring roller which will be described later; and 615 denotes a lever holder for attaching the operating lever 15 to an attachment portion 617 of the carriage 11. The reference numeral 619 denotes an upper attachment member for fixing upper edge portions of the flexible substrate 604 forming an end portion of the flexible cable 21 and of the rubber pad 605 to the supporting plate 606; and 621 denotes a lower attachment member for fixing lower edge portions of these elements 604, 605 to the supporting plate 606.

In addition to the construction above mentioned, in the illustrated embodiment, a substrate cover 623 is provided for covering the flexible substrate 604 during the non-use of the head cartridge 9, thus protecting the flexible substrate 604 and the circuit connected thereto from being touched by an operator or from being damaged or being subjected to an electrostatic force due to such touching by the operator. The substrate cover 623 is mounted on the lower attachment member 621 for pivotal movement around pins 621A formed on the lower attachment member. The reference numeral 625 denotes a spring for biasing the substrate cover 623 toward a position where it covers the flexible substrate 604; and 627 denotes a recess for receiving the substrate cover 623 when the head cartridge 9 is mounted on the carriage.

Next, an operation of the substrate cover 623 will be explained with reference to FIGS. 7B and 7C.

Figure 7B:
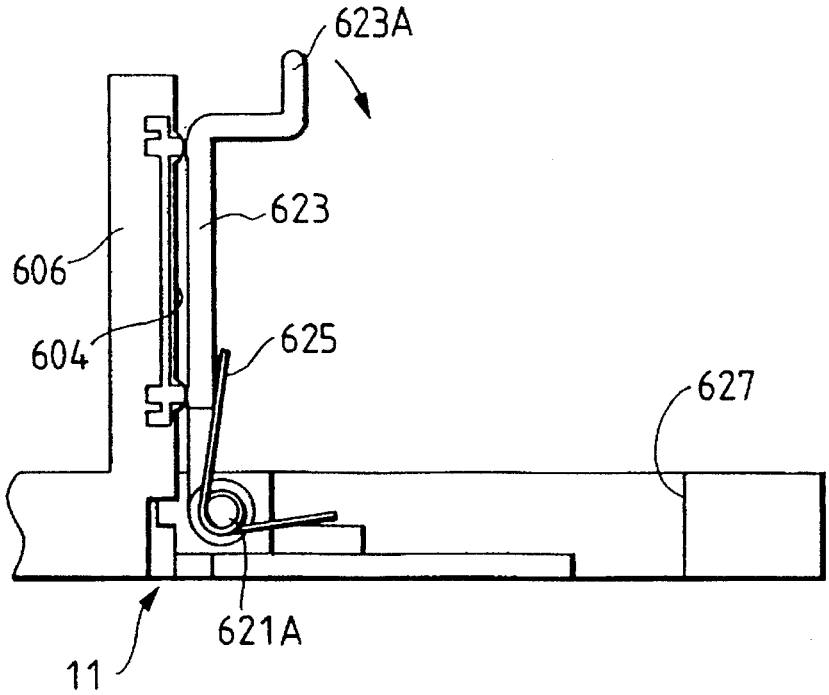
Figure 7C:
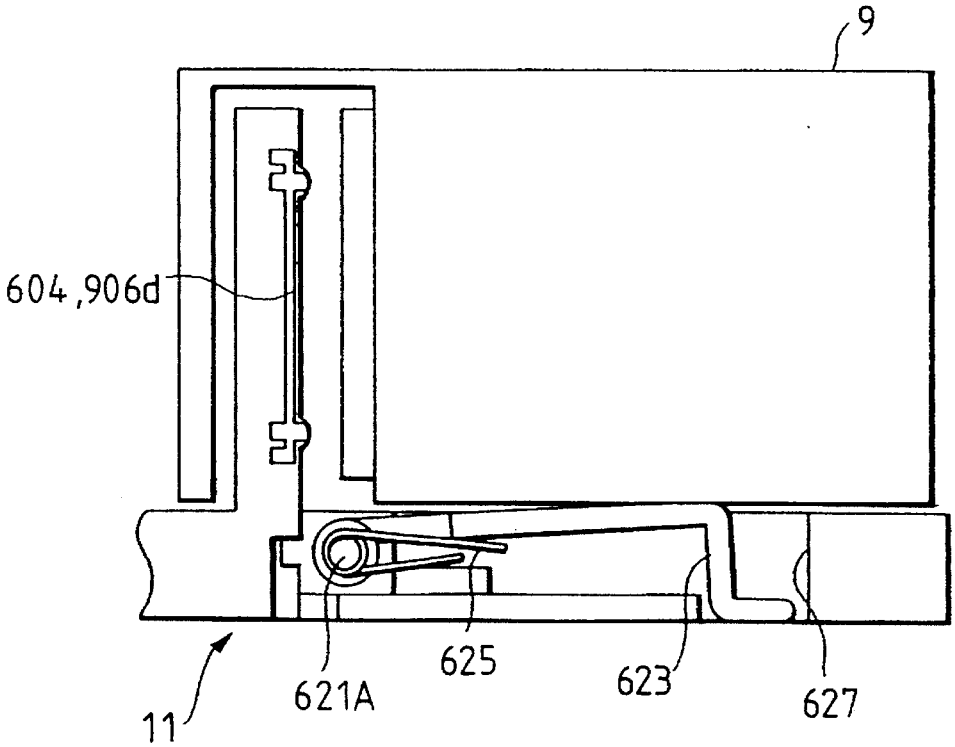
FIG. 7C is a side view showing a condition that the head cartridge is mounted on the carriage.

When the head cartridge 9 is not mounted on the carriage, as shown in FIG. 7B, the substrate cover 623 covers the flexible substrate 604 with the aid of the biasing force of the spring 625. In this condition, when the head cartridge 9 is mounted on the carriage from the above, through the engagement between an operating portion 623A of the substrate cover 623 and the bottom of the head cartridge or the operator's hand, the substrate cover 623 is rotated around the pins 621A in a clockwise direction (FIG. 7B) in opposition to the biasing force of the spring 625. When the head cartridge 9 is mounted on the carriage completely and the flexible substrate 604 is abutted against the substrate 604*d* of the head, as shown in FIG. 7C, the cover 623 is received into the recess 627 with being pressed down by the bottom of the head cartridge 9. Incidentally, since when the head cartridge 9 is removed the cover 623 immediately returns to its original position as shown in FIG. 7B, the flexible substrate 604 can be protected.

Figure 8A:
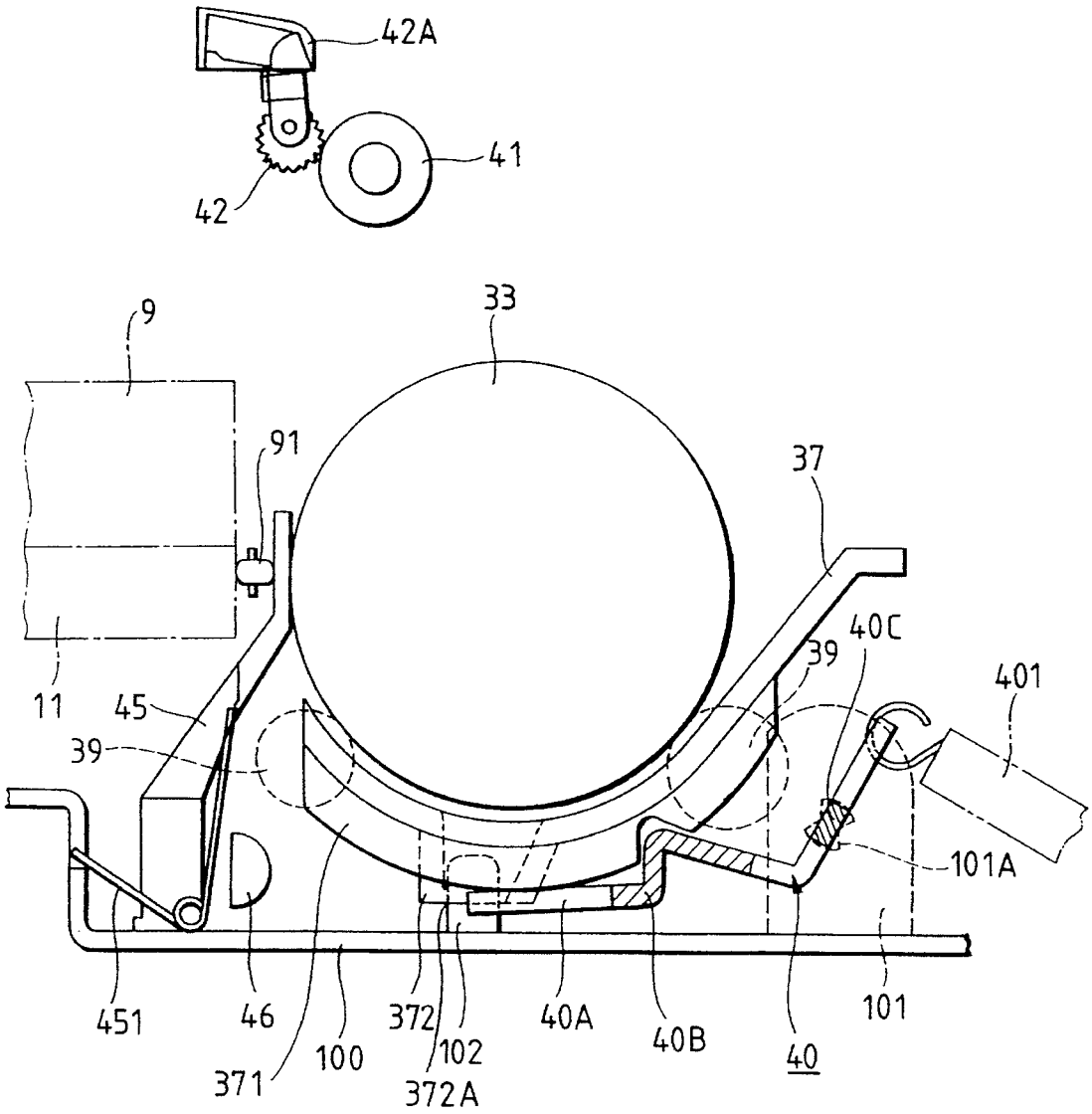
FIGS. 8A and 8B are an elevational sectional view and an exploded plan view of a recording sheet feeding or conveying system in the printer of FIG. 2, respectively.

FIG. 8A is a schematic side view showing mainly a recording sheet feeding system of the printer shown in FIG. 2 and the like, where the arrangement of various elements is shown at a normal recording sheet feeding operation.

The recording sheet supplied from a sheet supply tray (not shown) is introduced into a feeding path defined between the conveying roller 33 and the paper pan 37. In this feeding path, when the conveying roller 33 is rotated in the clockwise direction (FIG. 8A), the recording sheet is conveyed by a friction force (created by the urging force of the feed roller 39) between the conveying roller 33 and the recording sheet. Thereafter, the recording sheet is directed between the conveying roller 33 and the sheet hold-down plate 45 and is conveyed by a friction force (created by the urging force of the hold-down plate 45) between the conveying roller 33 and the recording sheet. Further, the orientation of the recording sheet is regulated by the hold-down plate 45, and the recording sheet is conveyed between the ejector roller 41 and the spur 42 along the platen 34; meanwhile the image is recorded on the recording sheet by discharging the ink droplets from the recording head cartridge 9.

Figure 8B:
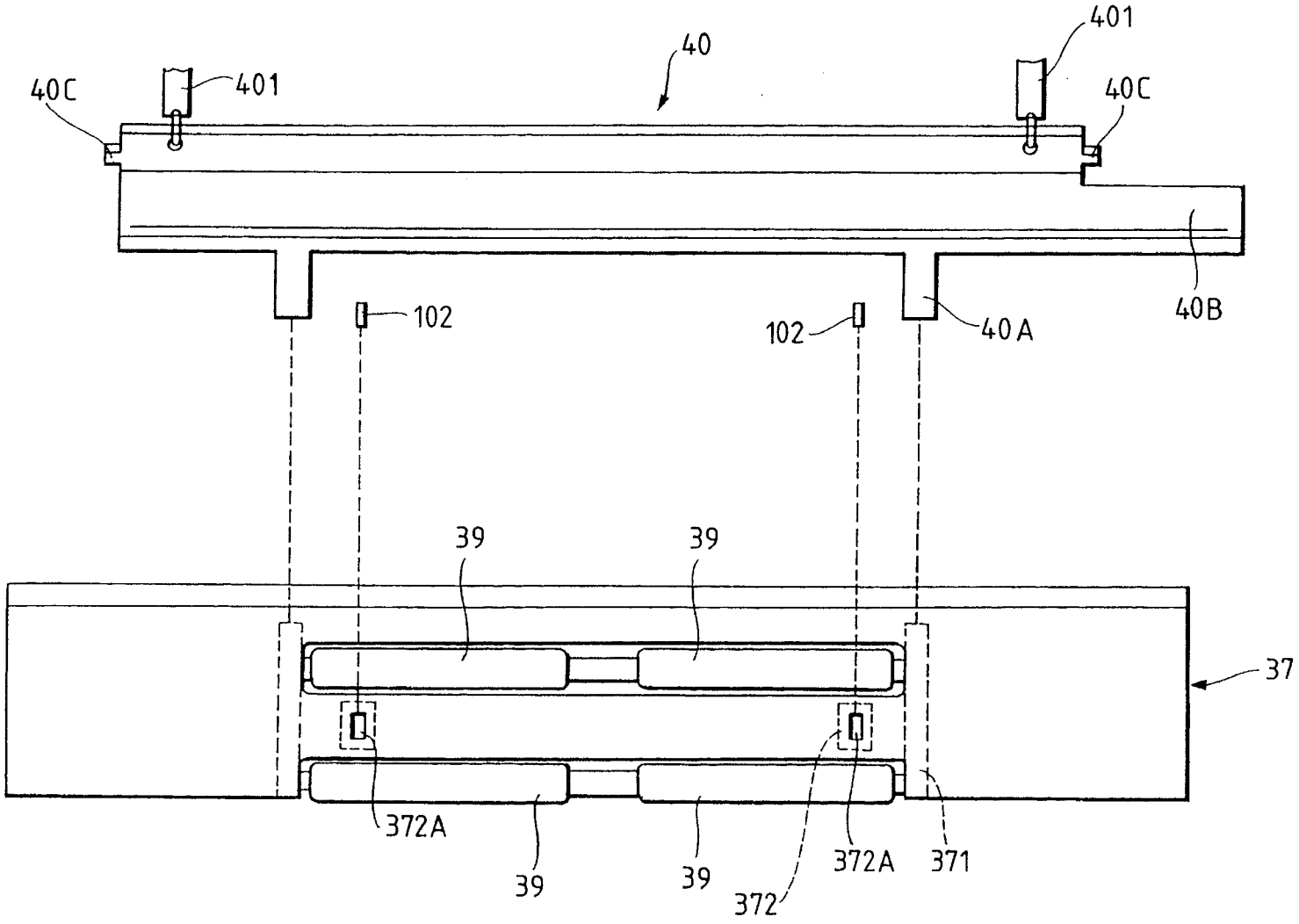

FIG. 8B is a plan view of the paper pan 37 and a release plate for biasing the paper pan toward the conveying roller 33. In this Figure, however, these elements are shown in a separated condition, for clarifying the explanation thereof.

Next, a mechanism for conveying or feeding the recording sheet will be explained with reference to FIGS. 8A and 8B.

In FIGS. 8A and 8B, the reference numeral 40 denotes the above-mentioned release plate adapted to urge the feed rollers 39 against the conveying roller 33 through the paper pan 37 and to release such urging action. More particularly, the release plate 40 is rotatably supported by release plate supporting members 101 uprightly formed on the bottom plate 100 of the apparatus by inserting pins 40C formed on both sides of the release plate 40 into corresponding pin receiving openings 101A formed in the supporting members 101. Thus, when the release plate 40 is biased rightwardly and downwardly (FIG. 8A) by two springs 401 connected to the release plate, this release plate 40 is rotated around the pins 40C in the clockwise direction. Two ribs 371 formed on the underside of the paper pan 37 are abutted against and urged by a pressurizing portion 40A of the release plate 40 upwardly (FIG. 8A) during the clockwise rotation of the release plate. Consequently, the feed rollers 39 rotatably supported by the ribs 371 are pressed against the conveying roller 33.

The releasing of the urging force by means of the release plate 40 is effected by pushing a shoulder 40B formed at one side of the release plate downwardly (FIG. 8A) in opposition to the biasing forces of the springs 401, as will be described with reference to FIG. 9. When the urging force is released, the paper pan 37 and the feed roller 39 are shifted downwardly due to their own weights, thus creating a predetermined clearance between the feed roller 39 and the conveying roller 33.

The reference numeral 372 denotes rectangular projections formed by extending parts of the paper pan 37 downwardly. Each rectangular projection 372 has a rectangular opening 372A into which a corresponding projection 102 formed on the bottom plate 100 is inserted with a predetermined clearance. Due to such engagement between the rectangular openings 372A and the projections 102, the paper pan 37, and accordingly the feed roller 39 are positioned in place with respect to the conveying roller 33.

With the above-mentioned arrangement including the predetermined clearance in the engagement between each rectangular opening and the corresponding projection, it is possible to eliminate the bad influence due to a so-called "kicking" caused when a trailing end of the recording sheet being conveyed has just passed through the feed roller 39.

Figure 9A:
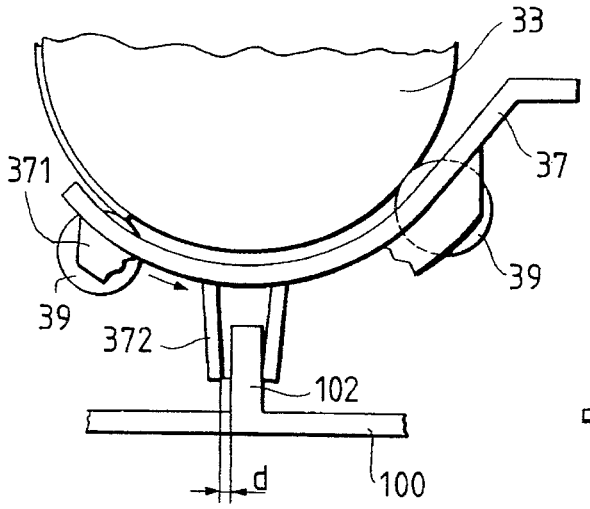
FIGS. 9A and 9B are schematic elevational views showing an escape mechanism of a feed roller in the recording sheet feeding system.
Figure 9B:
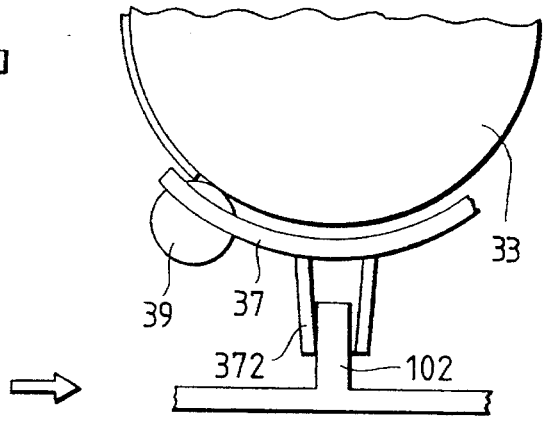

That is to say, while the recording sheet is fed from a condition that the trailing end of the recording sheet is pressed against the conveying roller 33 by means of the feed roller 39 as shown in FIG. 9A to a condition that the recording sheet passes through the nip between the feed roller 39 and the conveying roller 33 to contact them with each other as shown in FIG. 9B, the recording sheet is pushed out between the feed roller 39 and the conveying roller 33.

Figure 9C:
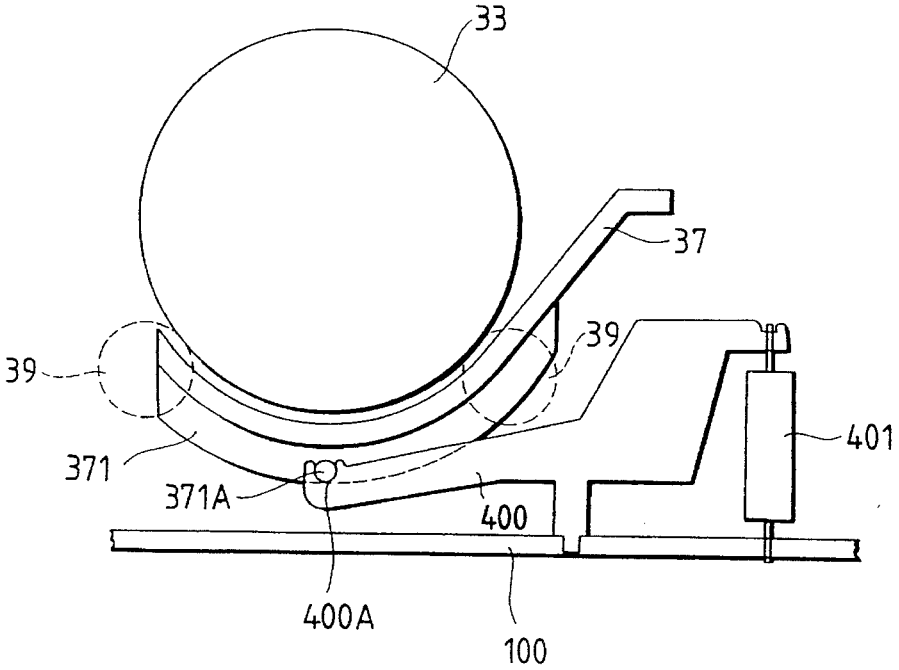
FIG. 9C is a schematic elevational view showing an example of a conventional biasing mechanism for the feed roller.

To the contrary, in the conventional arrangement, particularly when the recording sheet is a thicker one such as an envelope or a thicker paper, the above-mentioned "kicking" phenomenon occurs due to forces acting on various elements during such pushing-out action. For example, in the conventional arrangement for supporting the paper pan as shown in FIG. 9C, i.e., the arrangement wherein a boss 371A is supported within an engagement portion 400A of a biasing member 400 in such a manner that the boss cannot be shifted in the front-and-rear direction (left-and-right direction in FIG. 9C), since the feed roller 39 cannot escape in a direction opposite to the pushing-out direction, during the pushing-out action, the conveying roller 33 is excessively rotated by an amount corresponding the backlash in the driving mechanism, thus feeding the recording sheet excessively. As a result, the positional discrepancy of the recording position on the recording sheet will occur.

However, in the arrangement according to the illustrated embodiments of the present invention as shown in FIGS. 8A, 9A and 9B, during the pushing-out action, since the paper pan 37 can escape in the right direction (FIG. 9A) by an amount corresponding to the above-mentioned predetermined clearance d and the recording sheet and the conveying roller 33 are not subjected to the pushing force, the problem regarding the positional discrepancy as mentioned above does not occur.

Referring to FIG. 8A again, the reference numeral 451 denotes a spring for biasing the sheet hold-down plate 45 toward the conveying roller 33. The spring 451 has one end extending from a coil-shaped base portion and engaging by a part of the hold-down plate 45, and the other end engaging by a part of the bottom plate 100. The coil-shaped base portion of the spring is supported on a shaft formed on the bottom plate 100. The hold-down plate 45 is also biased by the carriage 9 through a roller 91 disposed on the front part of the carriage 11 as will be described later. By the urging forces (acting on the hold-down plate) by means of the spring 45 and the roller 91, a distance between the discharge openings of the head cartridge 9 and the recorded surface of the recording sheet can be properly maintained.

Further, the hold-down plate 45 urges the recording sheet against the conveying roller 33 by the above biasing forces to create the friction force between the recording sheet and the conveying roller 33, by which friction force the recording sheet is conveyed.

In order to convey the recording sheet effectively in accordance with the various kinds of the recording sheets, the friction forces created between the hold-down plate and the recording sheet and between the conveying roller and the recording sheet must be properly selected. That is to say, the friction force created between the hold-down plate and the recording sheet is desired to be small as long as possible, and the friction force created between the conveying roller and the recording sheet is desired to be great as long as possible.

Further, the friction force between the hold-down plate and the conveying roller is desired to be small as long as possible, since, if this friction force is great, the motor and the like will be subjected to an excessive load if the idle conveyance is effected. To avoid this, if there is provided a predetermined gap between the hold-down plate and the conveying roller, it will be difficult to control the accuracy regarding the biasing of the recording sheet against the platen and the like.

In consideration of the above, in the illustrated embodiment of the present invention, the hold-down plate 45 is made of POM (polyacetal) material and the conveying roller 33 is made of CR (chloroprene rubber; hardness 60°/A scale) reinforced by monofibers of nylon resin of 5–10% (percentage by weight). Incidentally, the hold-down plate 45 may be made of fluororesin material.

Incidentally, while the hardness of the chloroprene rubber was 60°, if such hardness is within a range of 50°–70°, the conveyance of the recording sheet will not be subjected to a bad influence. Further, it is not necessary that the whole conveying roller 33 and the whole hold-down plate 45 are made of the above-mentioned materials, but only portions of these elements which are engaged by the recording sheet may be made of such materials, or layer made of such materials may be disposed on the hold-down plate and on the conveying roller.

By constituting the hold-down plate and conveying roller by the above-mentioned materials, since the coefficient of friction between the hold-down plate 45 and the recording sheet can be reduced, the above-mentioned arrangement wherein the hold-down plate 45 urges the recording sheet against the conveying roller 33 can be adopted to. Consequently, in comparison with the conventional case that the urging force could not be adjusted in accordance with the thickness of the various recording sheets, it is possible to easily control the distance between the recording sheet and the head cartridge. Further, since the coefficient of friction between the recording sheet and the conveying roller is great, during the conveyance of the recording sheet, there is no slip between the recording sheet and the conveying roller, thus conveying the recording sheet effectively.

In FIG. 8A, the reference numeral 46 denotes a shaft member extending in parallel with the hold-down plate 45 and rotatably supported at both ends by the frame of the apparatus and having a semi-circular (D-shaped) cross-section. During the conveyance of the recording sheet, as shown in FIG. 8A, the angular position of the shaft member 46 is so set that a straight side of the D-shaped cross-section thereof extends in the vertical direction (up-and-down direction in FIG. 8A). On the other hand, when the urging force to the conveying roller 33 by means of the hold-down plate 45 is released, as shown in FIGS. 10A, 10B, 11A and 11B, by rotating the shaft member 46 so that the straight side of the D-shaped cross-section thereof extends in the horizontal direction (left-and-right direction in FIG. 8A), the shaft member is engaged by a part of the spring 451 to displace the latter, thus releasing the engagement between the spring 451 and the hold-down plate 45. In this way, only the urging force of the hold-down plate 45 is released without changing the position of this plate.

Consequently, for example, in order to insert the recording sheet, even when the carriage 11 is activated in a condition that such urging force is released, the head cartridge and the carriage do not interfere with the hold-down plate, thus preventing the damage of the head cartridge and the carriage. In other words, even in the condition that the urging force of the hold-down plate is released, it is possible to perform various operations by shifting the carriage. Incidentally, in this case, although the urging force to the hold-down plate 45 through the roller 91 is not released, since this urging force acts on only one point of the hold-down plate 45 opposing the carriage 11, the insertion or introduction of the recording sheet is not influenced badly by this urging force.

In FIG. 8A, the reference numeral 41 denotes the above-mentioned ejector roller by which the spur 42 is engaged. The spur 42 is biased toward the ejector roller 41 by means of a biasing means shown in FIGS. 10A, 10B, 11A and 11B, thus conveying the recording sheet by a friction force (created by such biasing force) between the recording sheet and the ejector roller 41. The spur 42 is biased toward the ejector roller 41 through a holding member 42A therefor, and can be separated from the ejector roller 41 through this holding member.

Figure 8C:
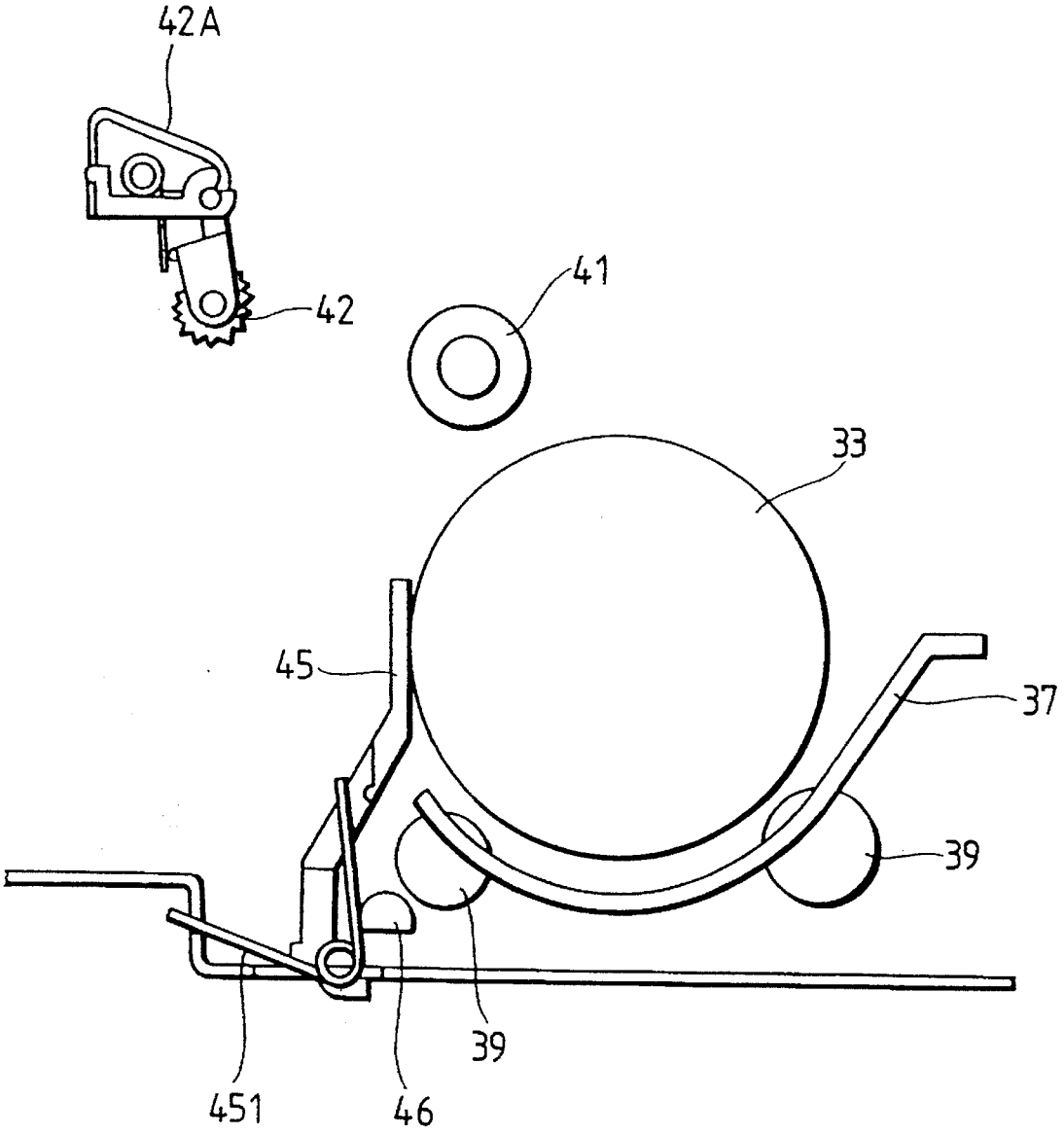
FIG. 8C is an elevational sectional view of the recording sheet feeding system in a condition that various biasing forces are released.

Regarding the paper pan 37 (and the feed roller 39), hold-down plate 45 and spur 42 shown in FIGS. 8A and 8B, the urging or biasing conditions therefor are released in the respective manners as mentioned above. These biasing condition releasing operations are effected simultaneously by manipulating the release lever 43 shown in FIG. 2, with the result that the condition as shown in FIG. 8C is obtained.

Figure 10A:
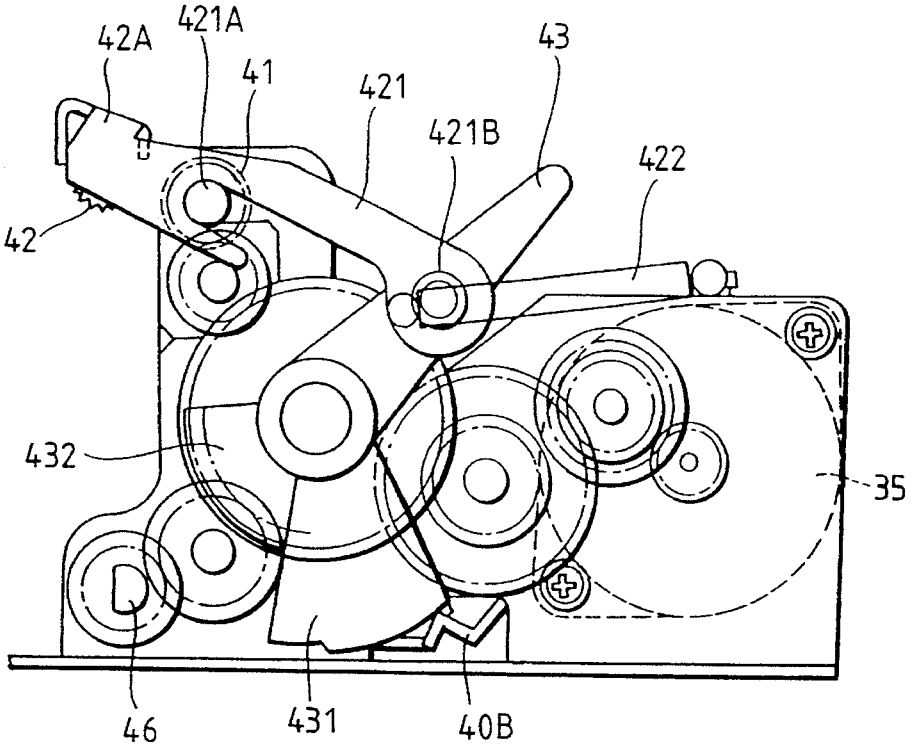
FIGS. 10A and 10B are elevational sectional views of a right half of a release mechanism for releasing the feed roller, sheet hold-down plate and spur in the feeding system, in non-released and released conditions, respectively.
Figure 10B:
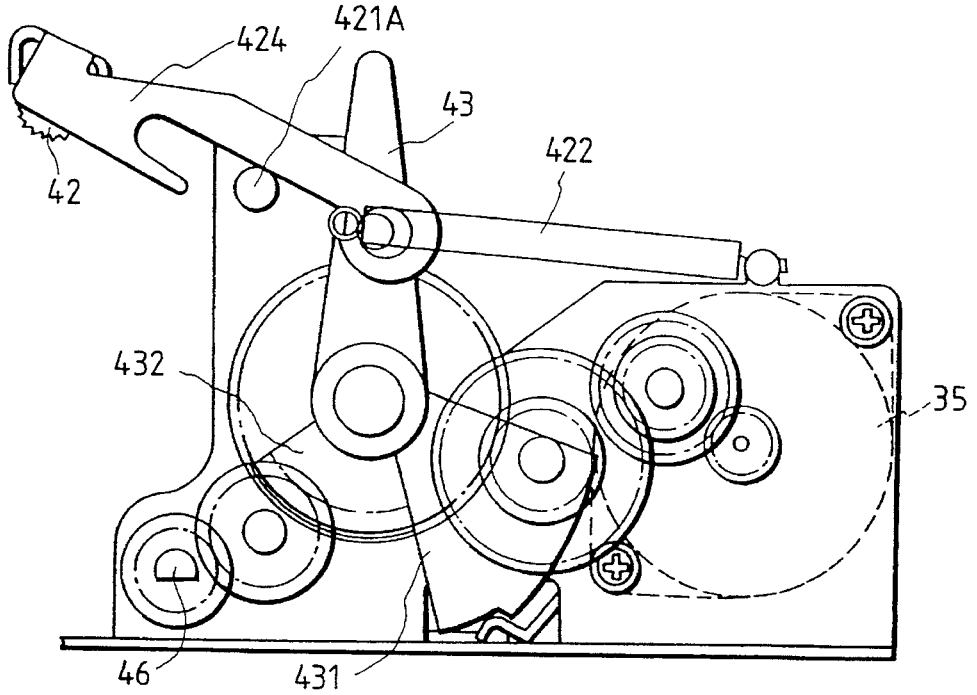
Figure 11A:
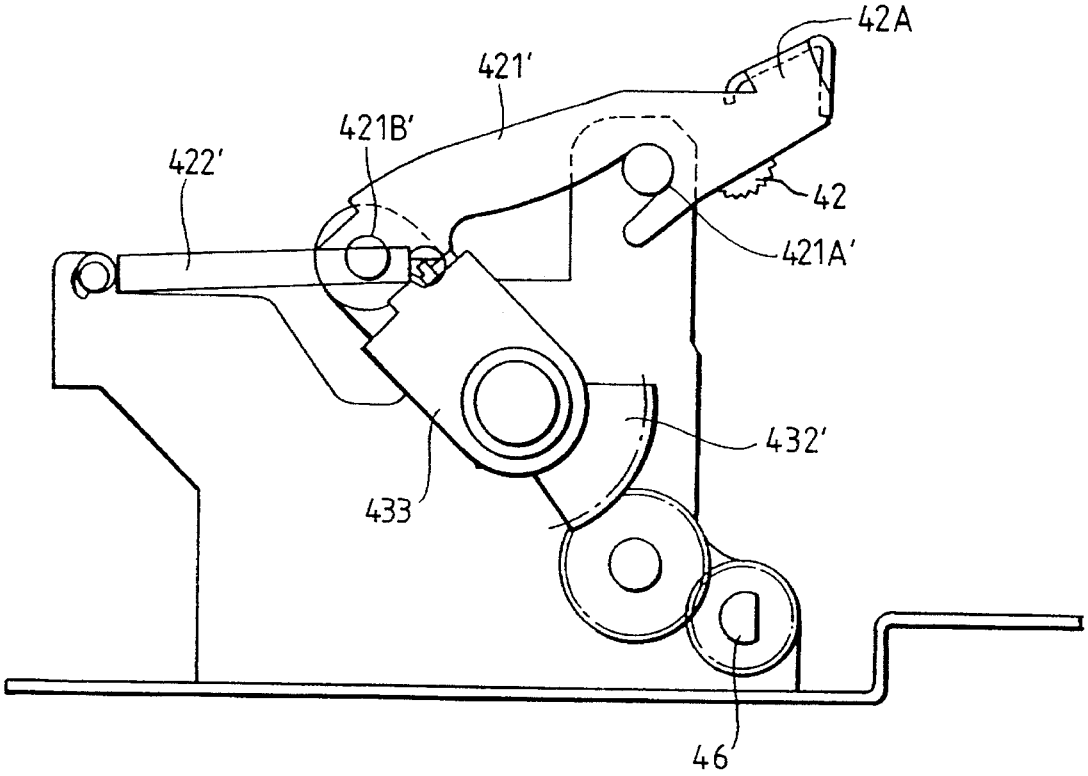
FIGS. 11A and 11B are elevational sectional views of a right half of the release mechanism, in non-released and released conditions, respectively.
Figure 11B:
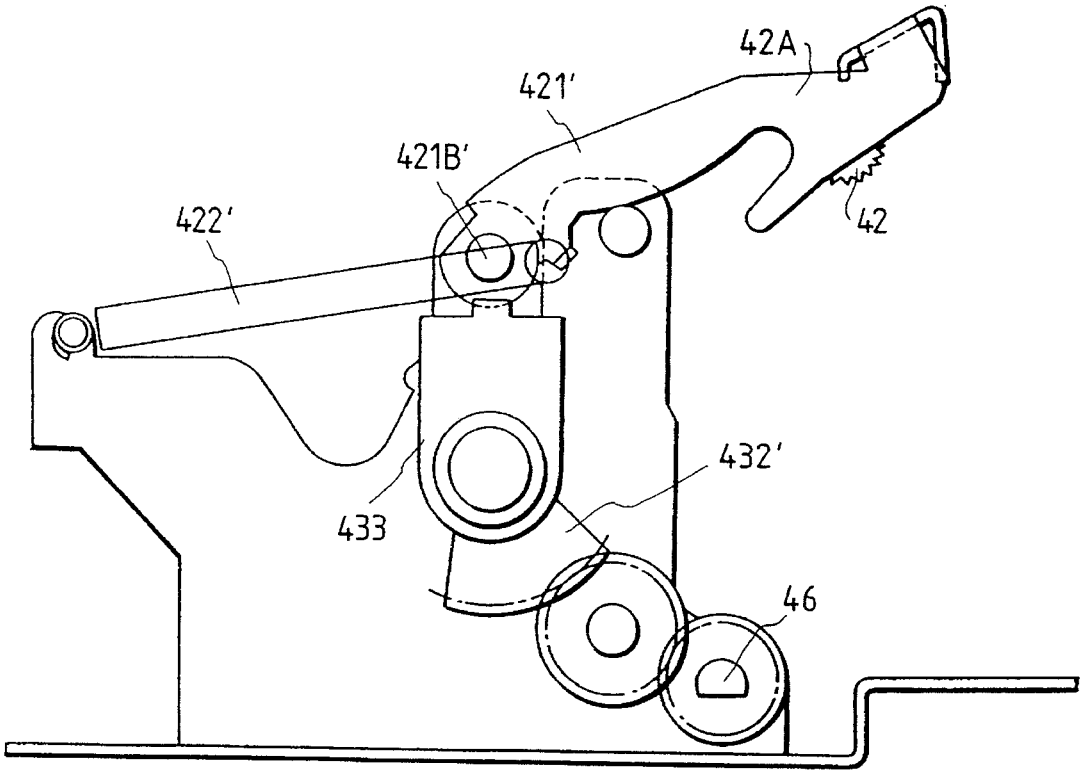

FIGS. 10A, 10B, 11A and 11B show a mechanism for releasing the biasing condition, and in particular, FIGS. 10A and 10B are side views of such release mechanism as viewed from the right side of the apparatus, and FIGS. 11A and 11B are side views of such release mechanism as viewed from the left.

FIGS. 10A and 11A show a condition that the biasing force is not released, for example, while the recording sheet is being conveyed. In this condition, the release lever 43 rotatably supported on a rotary shaft of the conveying roller 33 is in a laid condition by a biasing force of a spring which will be described later, with the result that a cam member 431 and a gear 432 fixed to the release lever 43, and a gear 432' fixed on the shaft coaxial with the conveying roller 33 at an end thereof remote from the release lever 43 are engaged by a gear train for rotating the shoulder 40B of the release plate 40 and the shaft member 46 in a predetermined positional relation. Further, spur arms 421, 421' extending from the spur holding member 42A and arranged on both sides thereof are connected at their connecting portions 421B, 421B' to the release lever 43 and a connecting member 433 and are biased rearwardly of the apparatus by tension forces of springs 422, 422' acting on the connecting portions. In this biased condition, engagement portions 421A, 421A' formed on the spur arms 421, 421' are engaged by a rotary shaft of the ejector roller 41, thus properly maintaining the positional relation between the spur 42 and the ejector roller 41, and the urging force to the ejector roller.

Since the engagement between the spur arm 421 and the release lever 43 is effected with a predetermined clearance, it is possible to obtain the proper engagement between the spur 42 and the ejector roller 41 without accurate configuration of the spur arm 421.

Further, the rotation of the release lever 43 is transmitted to the shaft member 46 through the gear and an intermediate gear train, and then is transmitted from the shaft member 46 to an intermediate gear train, the gear 432' and the connecting member 433 at the other end of the shaft member, thus shifting the spur arm 421' eventually. In this case, the play due to the backlash between the intervening gears is absorbed by the engagement relation between the release lever 43 and the spur arm 421 with the predetermined clearance.

Incidentally, the member that the biasing condition thereof is released by the above-mentioned arrangement is not limited to the spur, but may be any roller relating to the conveyance of the recording sheet.

FIGS. 10A and 11B show a condition that the biasing conditions regarding the spur 42, hold-down plate 45 and paper pan 37 are released. The releasing operation is effected by rotating the release lever 43 forwardly of the apparatus in opposition to the force of the spring 422. That is to say, when the release lever 43 is rotated forwardly, the gear 432 is also rotated. In this case, as mentioned above, the shaft member 46 is rotated through the intermediate gear train engaged by the gear 432 so that the straight side of the D-shaped cross-section of the shaft member is in the horizontal direction. Consequently, as mentioned above, the shaft member 46 urges the spring 451 to close the latter, thus separating the spring 451 from the hold-down plate 45, with the result that the biasing force to the hold-down plate 45 is released.

Further, in consequence of the rotation of the release lever 43, the cam member 431 is also rotated. The shoulder 40B of the release plate 40 described regarding FIG. 8A is engaged by the cam portion of the cam member 431, and, thus, in consequence of the rotation of the cam member 431, the release plate 40 is lowered, thereby separating the release plate from the ribs 371 of the paper pan 37 to release the urging force to the ribs 371. As a result, the biasing force urging the paper pan 37 (and the feed roller 39) against the conveying roller 33 is released, with the result that the paper pan 37 is lowered by its own weight. In consequence of the rotation of the release lever 43, since the shoulder 40B is eventually engaged by the stepped cam portion of the cam member 431, the engagement position therebetween is fixed, and, thereby, the rotation position of the release lever 43 is also fixed.

Further, in consequence of the rotation of the release lever 43, the spur arm 421 is shifted forwardly of the apparatus, and, as mentioned above, the other spur arm 421' is also shifted forwardly due to the rotational force transmitted through the shaft member 46. As a result, the spur 42 connected to the spur arms 421, 421' is separated from the ejector roller 41.

In this way, by rotating the release lever 43 once, it is possible to release the biasing forces of the paper pan 37, hold-down plate 45 and spur, and such releasing operation can be effected with a simple construction.

Incidentally, in the illustrated embodiment, while the paper pan was supported by the biasing force to the release plate and the engagement between the slot of the paper pan and the projection of the bottom plate of the apparatus, for example, an arrangement as shown in FIG. 9C may be used, wherein a slot is formed in the engagement portion 400 and the paper pan can escape in the longitudinal direction of the slot.

Figure 12:
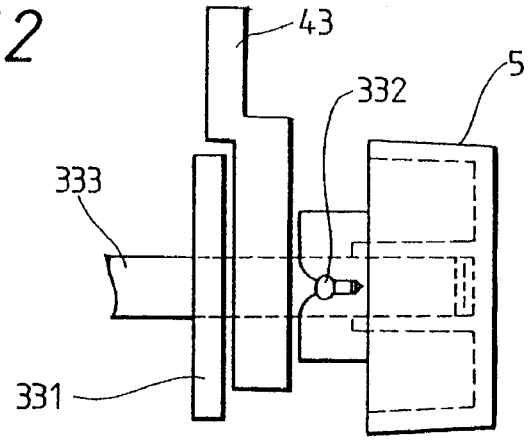
FIG. 12 is a schematic elevational view showing an engagement relation between a knob and a lever for releasing the biasing condition.
Figure 13:
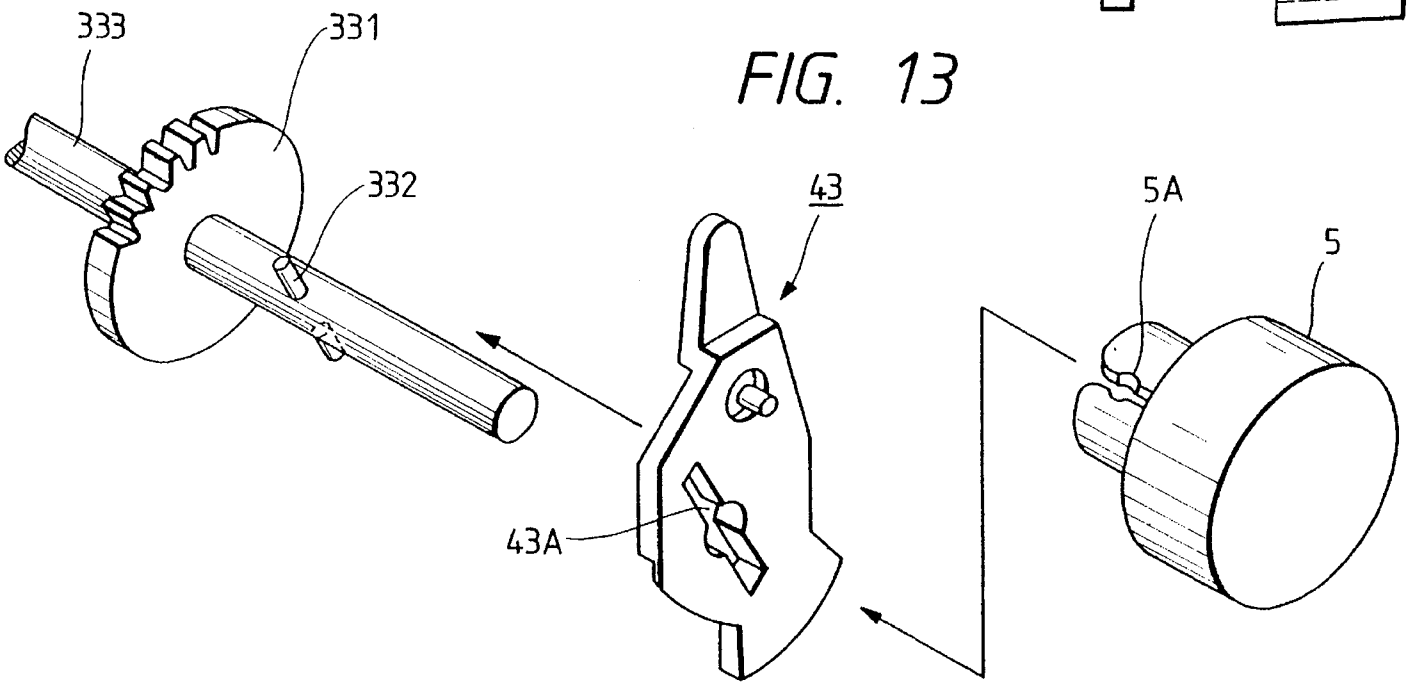
FIG. 13 is an exploded perspective view of a mechanism shown in FIG. 12.

FIG. 12 is a schematic plan view showing an assembled condition wherein the knob fixed to the rotary shaft of the conveying roller 33 and the release lever are assembled together, and FIG. 13 is an exploded perspective view of such knob and release lever.

In FIG. 12, a driven gear 331 for rotating the conveying roller 33 is fixedly mounted on the rotary shaft 333 of the conveying roller 33, and the knob 5 is fixed to the shaft 333 by spring pins 332 provided on the shaft 333. The release lever 43 is disposed between the driven gear and the knob and is rotatably supported on the shaft 333. However, the pivotal movement of the release lever is limited by the spring and the like, as mentioned above.

FIG. 13 is an exploded view for explaining an assembling sequence for assembling the above-mentioned elements. As shown in FIG. 13, the spring pins 332 are previously embedded in the shaft 333 and the gear 331 is previously fixed onto the shaft 333. On this shaft 333, the release lever 43 is inserted through an opening 43A. As shown in FIG. 13, the opening 43A has a configuration which can receive the shaft 333 and the spring pins 332, so that the release lever 43 can be moved beyond the spring pins 332 fixed to the shaft 333 toward the gear 331. Thereafter, the knob 5 is fitted on the shaft 333 while press-fitting retaining recesses 5A of the knob on the spring pins 332, thus fixing the knob 5 onto the shaft 333.

With this arrangement, the axial movement of the release lever 43 is limited by the gear 331 and the knob 5, and the knob 5 is fixed to the shaft by means of the spring pins 332. Further, since the spring pins 332 are previously driven in the shaft 333, the assembling operation will be easier than a case where the spring pins are driven in the shaft after the release lever has been assembled on the shaft.

Figure 14:
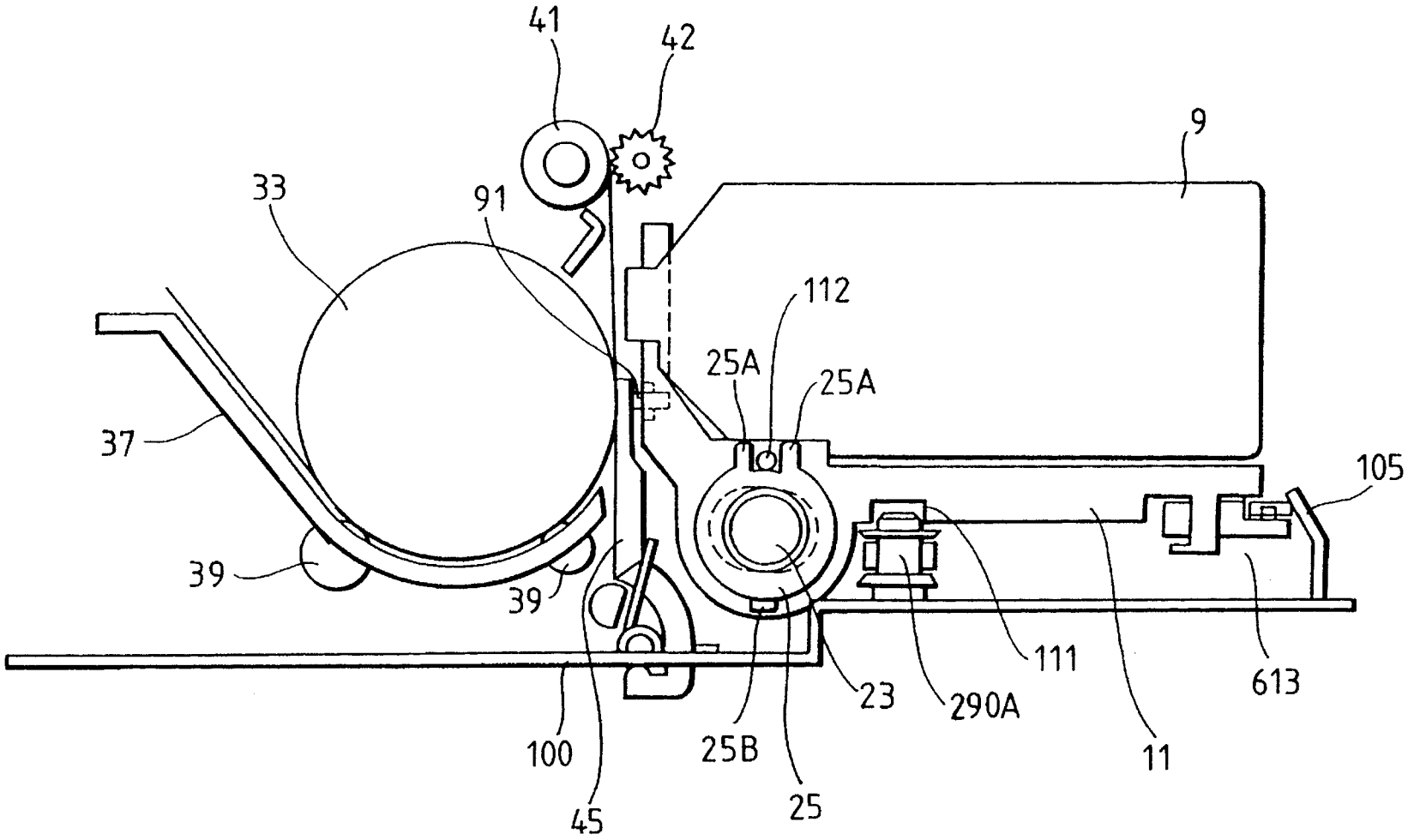
FIGS. 14 and 15 are a side view and a plan view for explaining an engagement relation between other elements of the carriage shown in FIG. 2 and the like, respectively.
Figure 15:
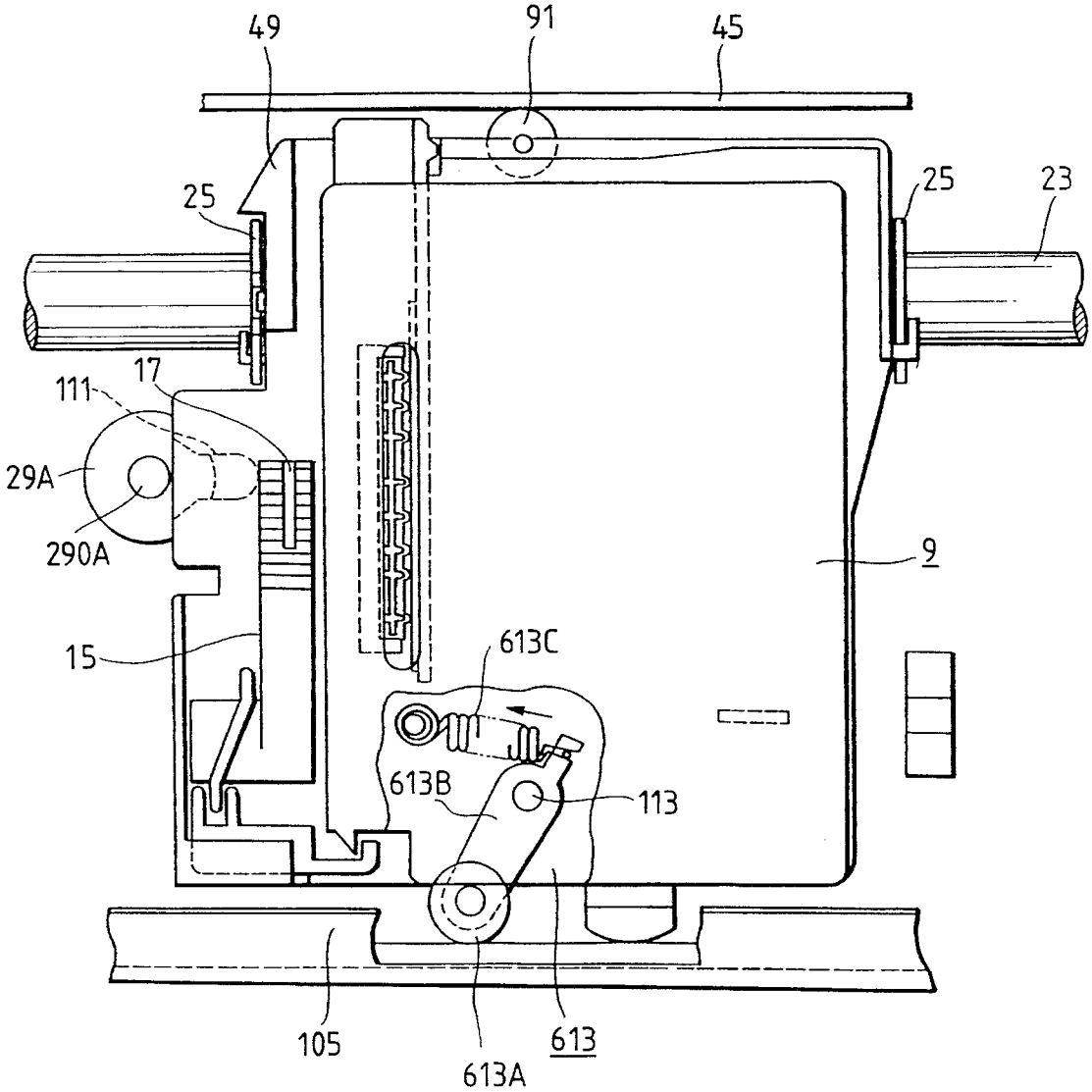

FIGS. 14 and 15 are a side view and a plan view showing mechanisms disposed around the head cartridge as shown in FIG. 2.

In FIGS. 14 and 15, the above-mentioned roller 91 rotatably supported at the front part of the carriage 11 is so arranged that a part of this roller protrudes forwardly from the discharge opening forming surface of the head cartridge and is abutted against the hold-down plate 45 to rotate thereon. The reference numeral 613 denotes a roller spring disposed at a rear end of the carriage 11 and comprising a roller 613A, a connecting member 613B for rotatably supporting the roller 613A and a spring 613C for biasing the connecting member 613B toward a predetermined rotational direction.

The roller 613A is abutted against a front end plate 105 uprightly formed on the front end portion of the bottom plate 100 to extend in parallel with the aforementioned guide shaft and can be rotated on the end plate 105. The connecting member 613B is rotatably supported on a predetermined shaft 113 of the carriage 11, and the spring 613C is connected between a pin of the carriage and the connecting member 613B to bias the latter in an anti-clockwise direction around the shaft 113. With the above-mentioned arrangement of the roller spring 613, the carriage 11 is always biased toward the hold-down plate 45.

The reference numeral 25 denotes the above-mentioned bearings engaged by the guide shaft 23 and disposed on both sides of the carriage 11. As will be described later, the bearings 25 have bearing portions eccentric to the case of the apparatus, and the two bearings 25 are so mounted that they are eccentric to each other in opposite directions.

Further, the bearing 25 disposed at a side shown in FIG. 14 is mounted for pivotal movement around a boss 112 formed on the carriage 11. More particularly, this bearing 25 is mounted within a slot formed in the carriage 11, and the movement of two projections 25A of the bearing 25 is limited by the boss 112 in the front-and-rear direction (left-and-right direction in FIG. 14). Consequently, in response to the movement of the carriage 11 which will be described later, this bearing 25 is pivotally moved relative to the carriage 11. Incidentally, in this case, the movement of this bearing 25 along the guide shaft 23 is limited by engaging a projection 25B of the bearing 25 by a part of the carriage 11 (for example, see FIG. 7A).

Next, an automatic adjustment of the distance (also referred to as "gap" hereinafter) between the recording sheet and the discharge opening forming surface of the head cartridge on the basis of the above-mentioned arrangement of the roller 91, roller spring 613 and springs 25 will be explained with reference to FIGS. 16A, 16B and 17.

The automatic adjustment of the gap is effected in accordance with the thickness of the recording sheet inserted between the hold-down plate 45 and the platen roller or conveying roller 33. When the recording is performed regarding a relatively thinner and normally used recording sheet $P_1$ as shown in FIG. 16A, the left (FIG. 16A) bearing 25 is situated substantially in a central position of the slot. That is to say, the carriage 11 is biased toward the hold-down plate 45 by a reaction force from the front end plate 105 generated by the fact that the roller spring 613 urges the front end plate 105, with the result that the roller 91 urges the hold-down plate 45. The reaction forces generated, respectively, by the facts that the roller 91 urges the hold-down plate 45 and that the roller spring 613 urges the front end plate 105 create moments around the right (FIG. 16A) bearing 25; by balancing these two moments, the position of the bearing 25 in the slot is determined.

In other words, the position of the carriage 11 relative to the bearing 25, and, accordingly the guide shaft 23 fixed to the printer is determined; thus, the gap d between the discharge opening forming surface of the head cartridge 9 mounted on the carriage and the recording sheet is also determined.

Figure 16B:
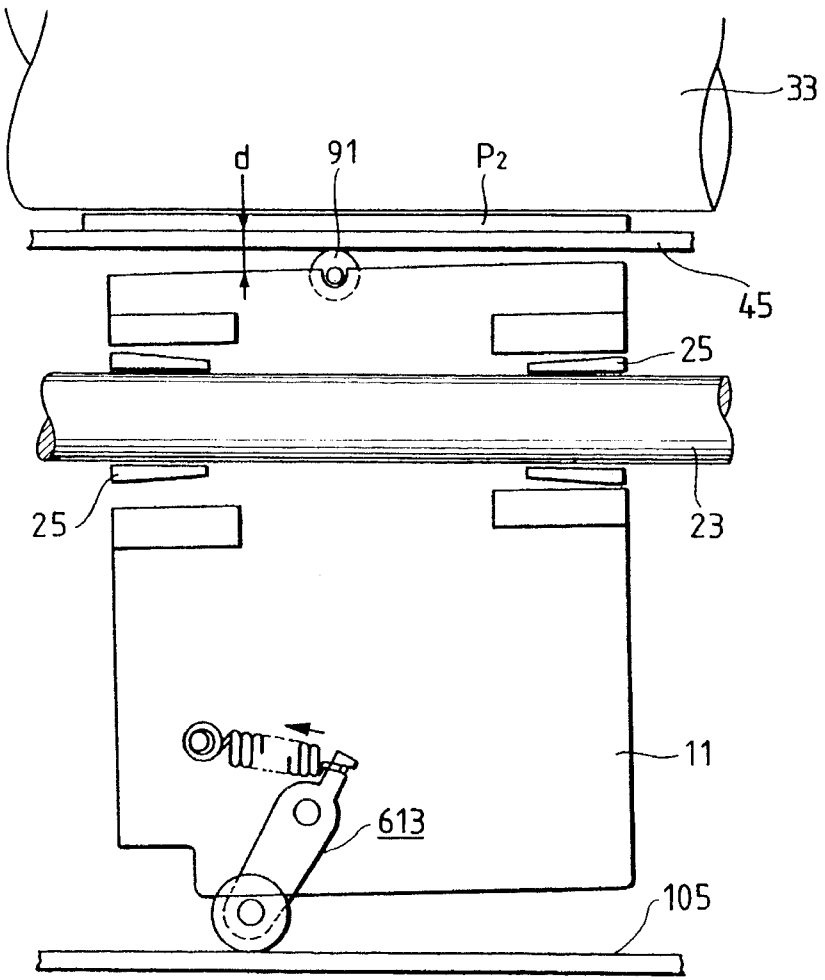
FIGS. 16A and 16B are schematic plan views showing a manner in which a position of the carriage is varied in accordance with a thickness of a recording sheet.
Figure 16A:
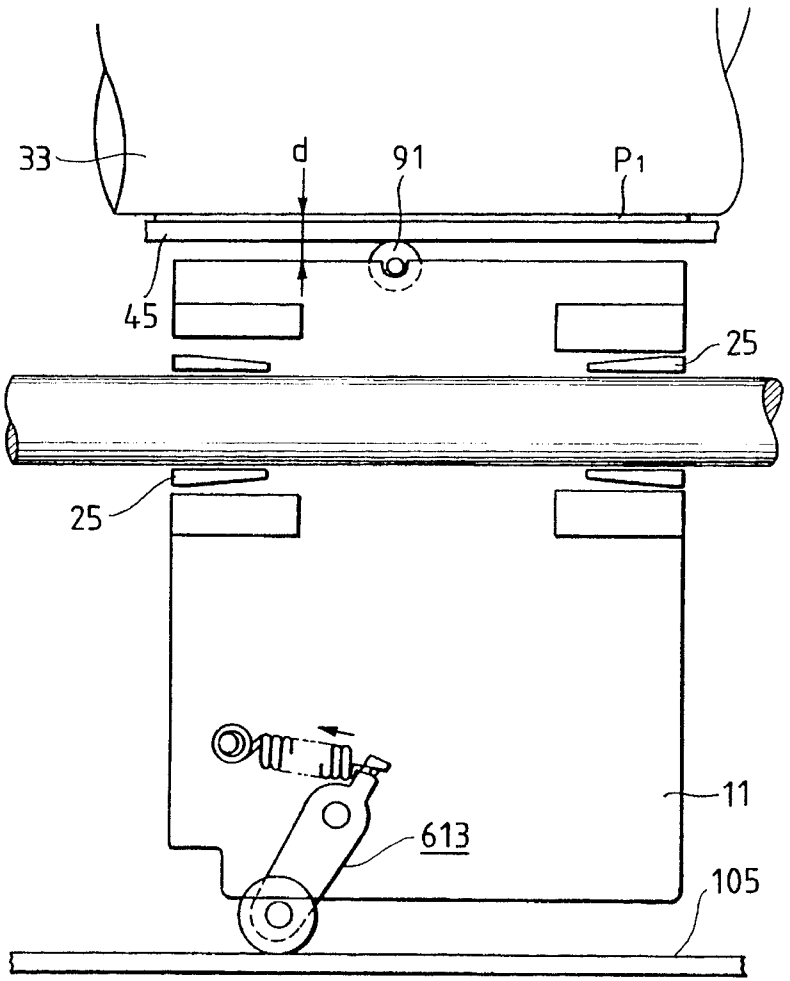
Figure 17:
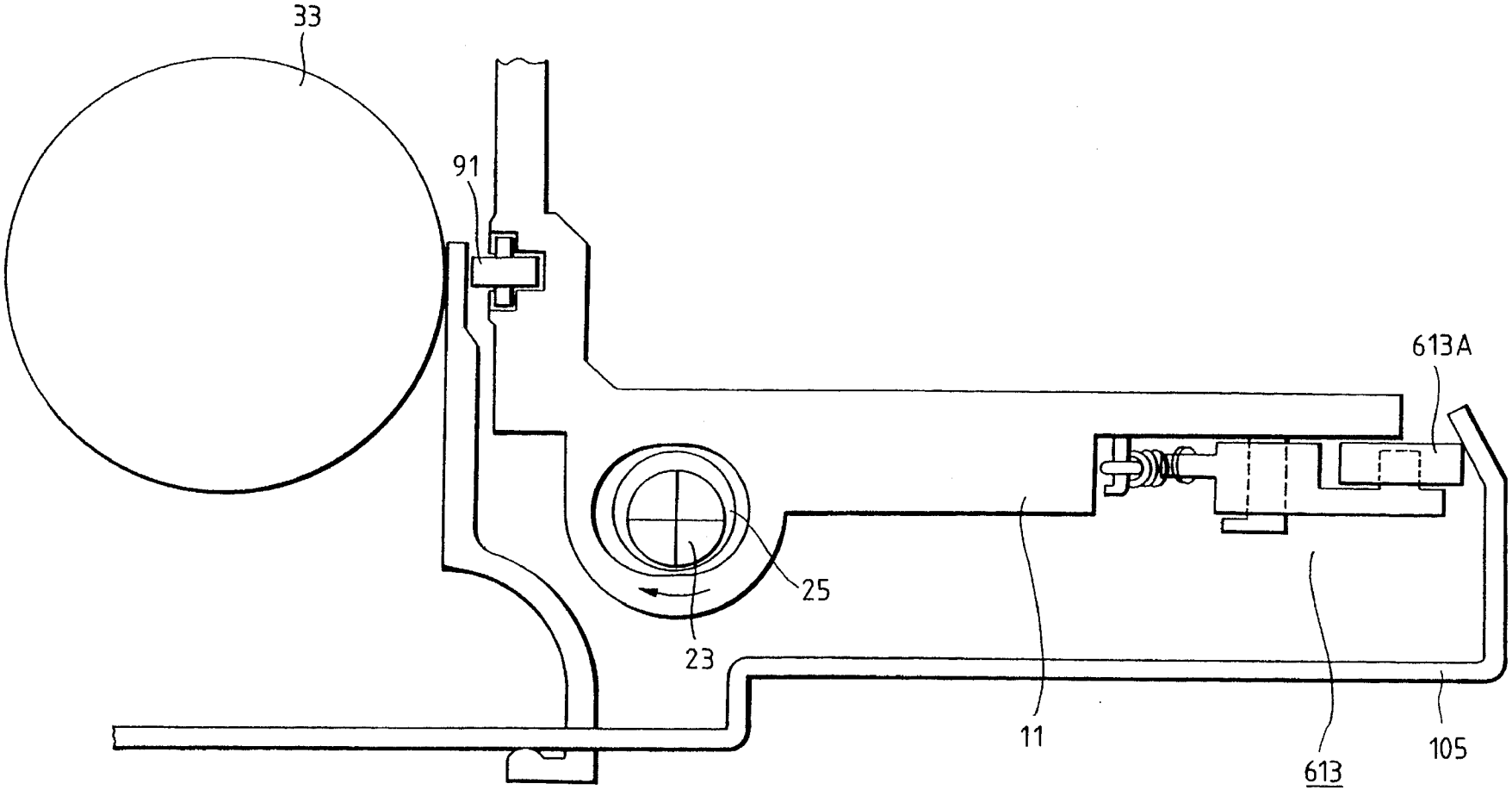
FIG. 17 is a schematic elevational view for explaining the change in a guide bearing in accordance with such variation in position of the carriage.

FIG. 16B shows the position of the carriage 11 when the recording is performed regarding a relatively thicker recording sheet $P_2$ such as an envelope. In this case, the roller 91 and accordingly the carriage 11 are retracted downwardly in accordance with the thickness of the recording sheet, in comparison with the case shown in FIG. 16A. Consequently, the reaction force from the front end plate 105 due to the roller spring 613 is varied, with the result that the balancing position where the two moments are balanced is also varied. As a result, the relative position between the left (FIG. 16B) bearing 25 and the carriage 11 is varied, with the result that the carriage 11 is inclined so that the front end (left end in FIG. 16B) thereof is lower than the rear end thereof, whereby the gap d between the discharge opening forming surface of the head cartridge and the recording sheet is substantially the same as that in the case of FIG. 16A. In this case, the left bearing 25 is pivoted as shown by the arrow in FIG. 17, thus changing its position in the slot.

Incidentally, according to the position where the roller 91 is provided, for example, a recording sheet (referred to as "thickest sheet" hereinafter) having a thickness thicker than the normal thicker recording sheet can also be treated. That is to say, according to the position where the roller 91 is provided, it is possible to withdraw the hold-down plate 45 a greater amount in accordance with the thickness of such thickest sheet and to maintain the gap to a constant value.

With the arrangement as mentioned above, as best seen in FIG. 17, since the roller 613A of the roller spring 613 is abutted against an inclined bent portion of the front end plate 105, the roller 613A is urged downwardly (FIG. 17), thus holding down the whole carriage 11. As a result, the floating of the carriage 11 is prevented, thus stabilizing the flying direction of the ink droplet discharged from the head cartridge 9 mounted on the carriage.

Referring to FIG. 15 again, a notch 111 formed in a left lower portion of the carriage 11 can be engaged by a pulley shaft 290A disposed near a home position. This engagement is attained as the carriage 11 moves to a cap position for the discharge opening forming surface; in this engagement position, the discharge opening forming surface is capped by the cap 51 (refer to FIG. 2).

Due to this engagement, for example, even if the recording system is subjected to vibration, since the carriage 11 cannot move in the front-and-rear direction, the cap 51 is not separated from the discharge opening forming surface of the head cartridge 9, thus performing the capping without fail.

Further, since the pulley shaft 290A acts as the member by which the notch 111 of the carriage 11 is engaged, a special element or member for this engagement is not needed, thus obtaining a more simple and cheaper construction.

In addition, the notch 111 is chamfered at its inlet portion to facilitate the introduction of the pulley shaft 290A thereinto. Thus, even when the carriage 11 moves in accordance with the thickness of the thicker or thickest sheet, such engagement can be easily attained.

Figure 18:
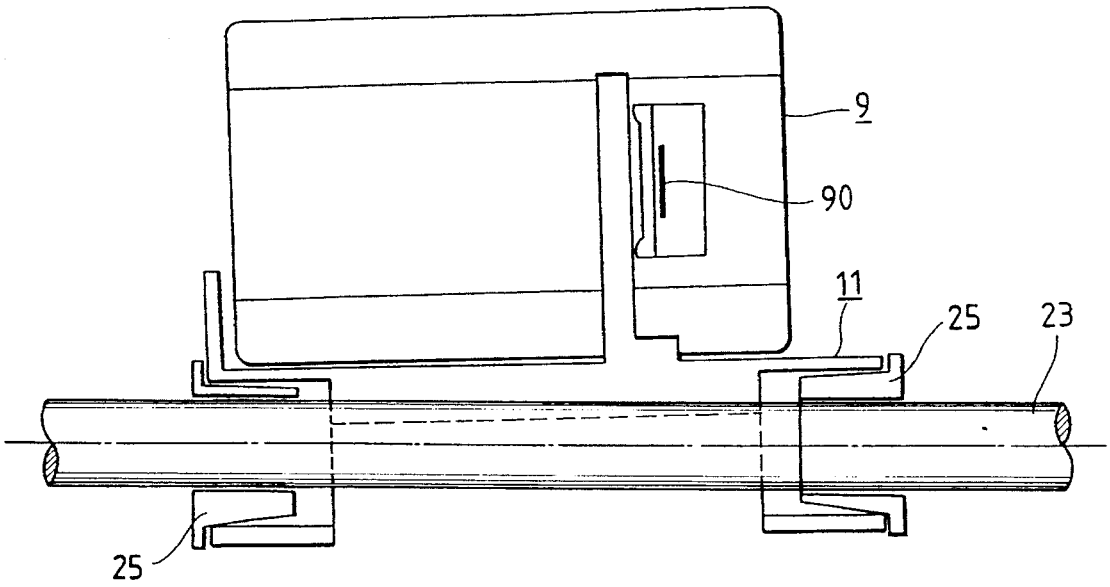
FIG. 18 is a schematic elevational view showing a mechanism for inclining an array of discharge openings with respect to a shifting direction of the carriage of FIG. 2.

FIG. 18 is a schematic elevational view of the head cartridge 9 and the carriage 11 as viewed from the recording sheet side. As is apparent from FIG. 18, the carriage 11 and the head cartridge 9 mounted thereon are inclined with respect to the longitudinal direction of the guide shaft 23 and accordingly the shifting direction of the carriage 11. In this case, the direction of the array of the discharge openings is similarly inclined.

Such inclination is attained by using the two bearings 25 each having the eccentric bearing portion as mentioned above, that is to say, as shown in FIGS. 14, 17 and the like, the left (right in FIG. 18) bearing 25 is so mounted that its eccentric center is situated in a lower position; whereas, the right (left in FIG. 18) bearing 25 is similar to the left bearing and is so mounted so that its eccentric center is situated in an upper position.

Figure 19A:
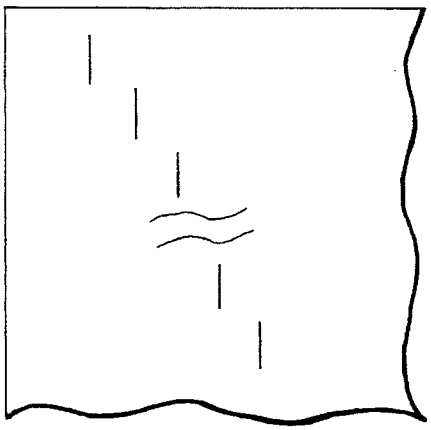
FIGS. 19A and 19B are schematic plan views showing an example of a recording pattern obtained when the discharge openings are not inclined and an example of the recording pattern obtained when the discharge openings are inclined, respectively.

The above-mentioned arrangement wherein the array of the discharge openings is inclined is adapted to a case where a plurality of discharge openings are driven in the time-shared manner. That is to say, generally, in driving the ink jet recording head, since the driving speed and the driving power can not be increased, time-shared driving is utilized. However, for example, when the time-shared driving is effected by dividing the sixty-four discharge openings longitudinally arranged into eight blocks, if the array of the discharge openings is not inclined, a recording as shown in FIG. 19A is effected, and the recorded image will be an oblique line when viewed macroscopically.

Figure 19B:
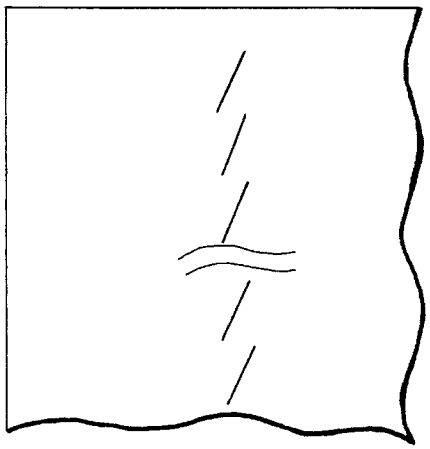

To the contrary, as in the illustrated embodiment, when the recording is effected by inclining the array of the discharge openings, an image as shown in FIG. 19B is obtained, and this image will be a straight line when viewed macroscopically. Incidentally, it should be noted that such an inclined arrangement is effective for not only time-shared driving by dividing the discharge openings into blocks, but also for the time-shared driving by dividing the discharge openings individually.

In the illustrated embodiment, such inclination is obtained by two bearings 25 mounted on both sides of the carriage 11. Since a distance between these bearings is relatively long, the accuracy of such inclination can easily be controlled. Further, such inclination can be simply attained by mounting the two identical bearings inversely with each other, the construction for obtaining such inclination becomes simple. Furthermore, if the timing of the time-shared driving differs due to the driving speed and the like, the inclination according to such timing can be attained by changing the bearings alone, without altering the carriage, recording head and the like. As a result, it is possible to commonly use the carriage and the like.

Figure 20A:
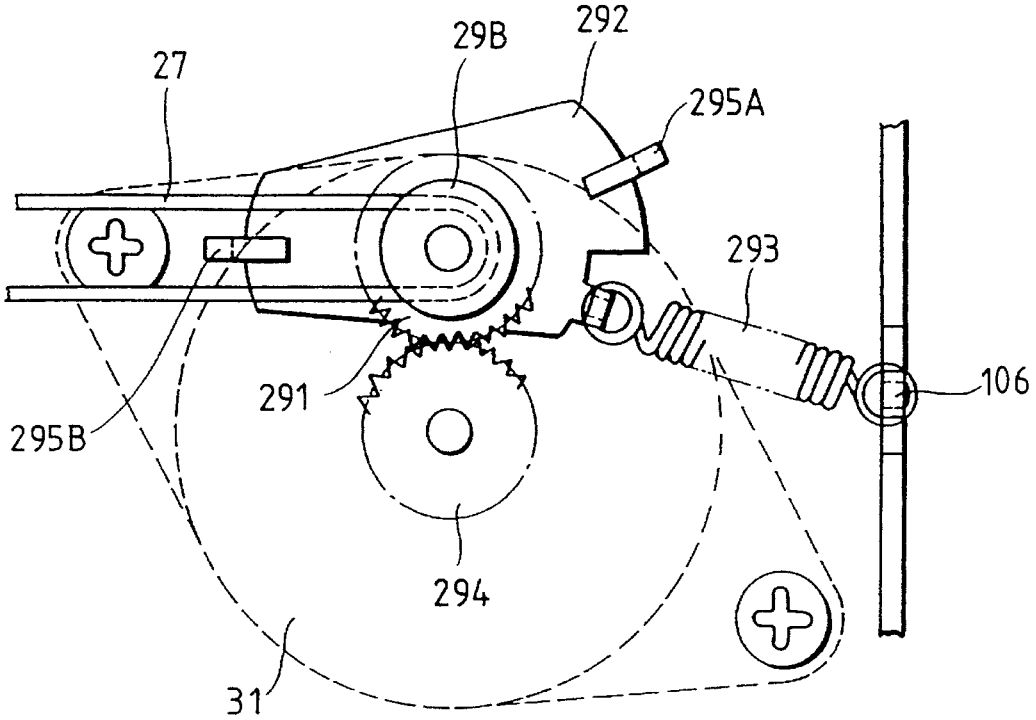
FIGS. 20A and 20B are a plan view and a side view showing a tensioning mechanism for a belt driving the carriage of FIG. 2 and a drive mechanism therefor, respectively.
Figure 20B:
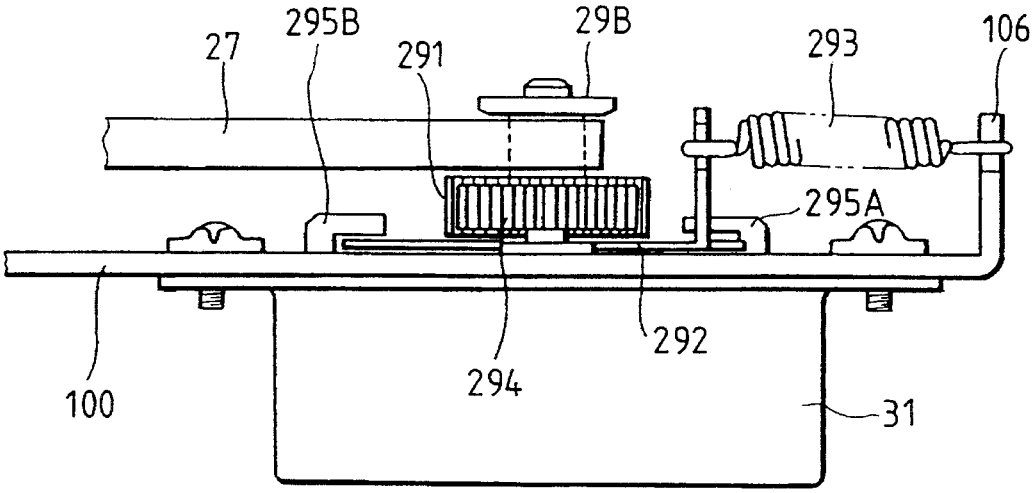

FIGS. 20A and 20B are a plan view and an elevational view showing the details of a right pulley 29B (and thereabout) of two pulleys for driving a timing belt to shift the carriage.

A driven gear 291 is coaxially fixed to the pulley 29B, which gear 291 is meshed with a driving gear 294 fixed to a rotary shaft of the carriage motor 31. A shaft on which the pulley 29B and the gear 291 are fixed is rotatably supported by a bracket 292.

A spring 293 is connected at its one end to the bracket 292, and the other end of the spring 293 is connected to a projection 106 uprightly formed on the bottom plate 100. Thus, the bracket 292 is biased in a direction inclined by a predetermined angle with respect to a direction to which the timing belt extends. In this case, the bracket 292 (and gear 291 and pulley 29B supported thereby) is freely moved, except that the movement of the bracket 292 in the up- and down direction and in a predetermined direction along the bottom plate 100 is limited by L-shaped members 295A, 295B uprightly formed on the bottom plate 100. Accordingly, the tension of the timing belt and the engagement force between the gears 291, 294 can be obtained in accordance with components of biasing force of the spring 293.

Figure 21:
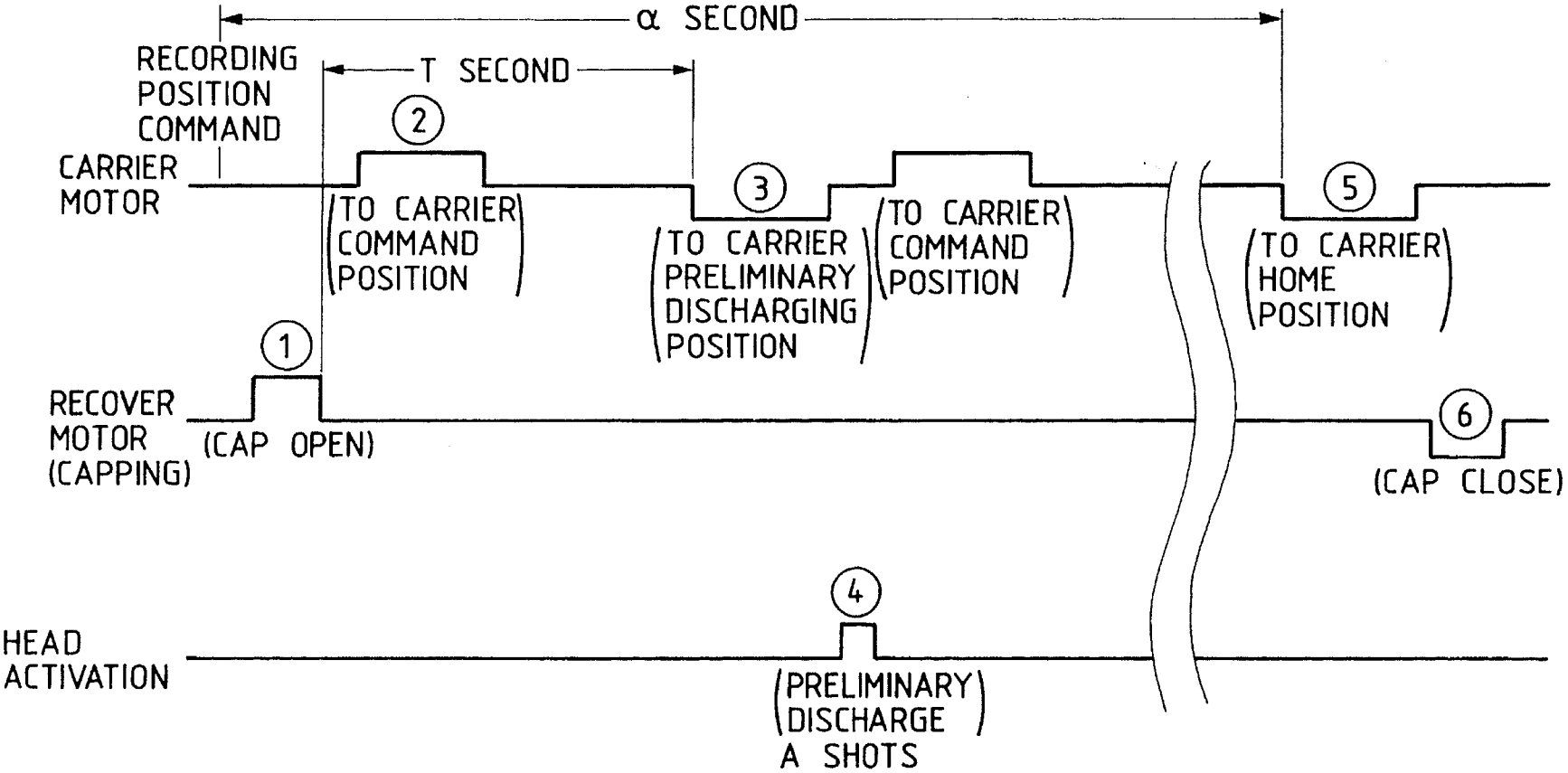
Figure 22:
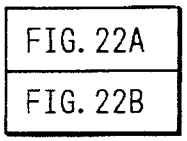
FIG. 22, including 22A and 22B is a flow chart for executing the recording position command mode.
Figure 22A:
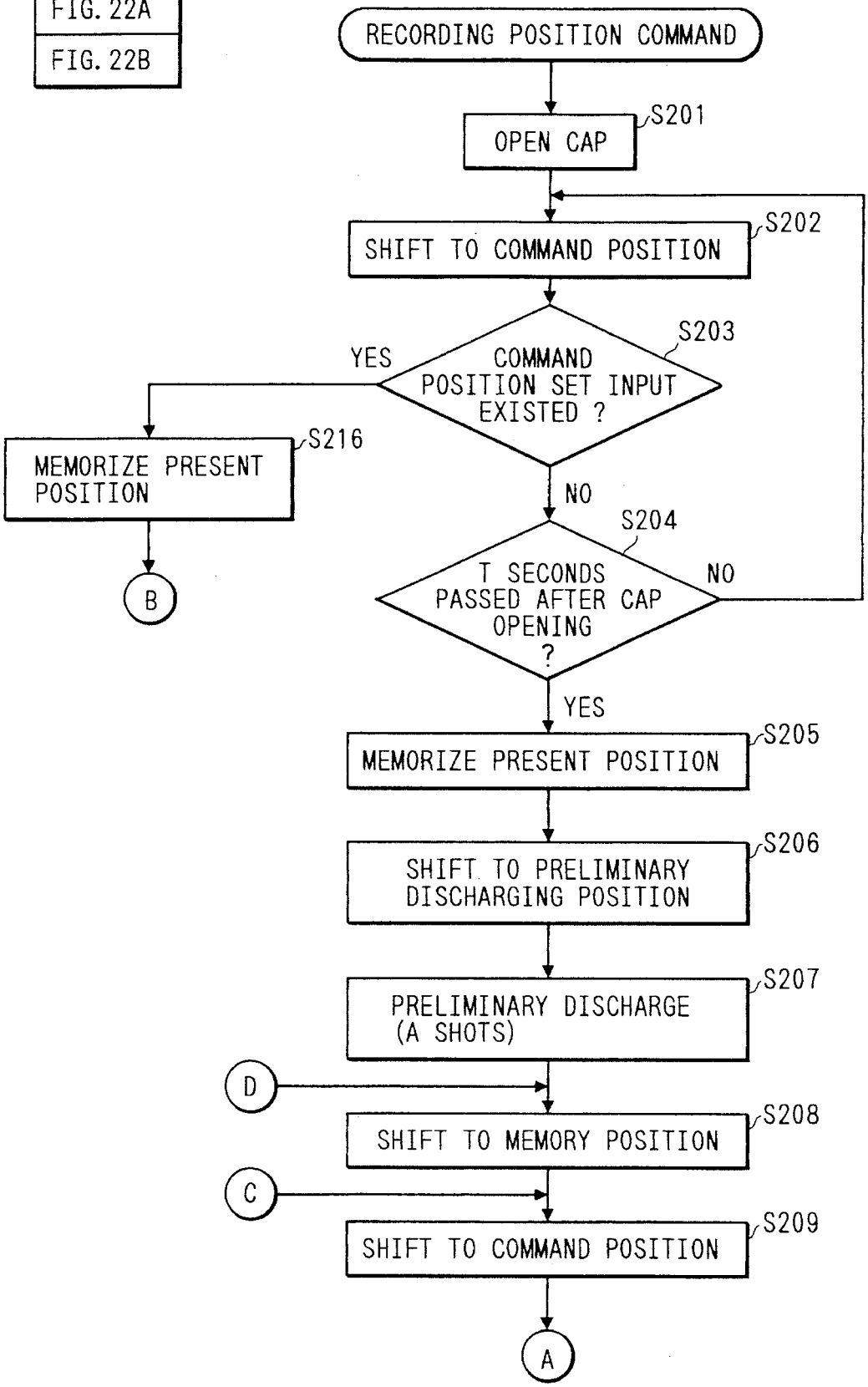
Figure 22B:
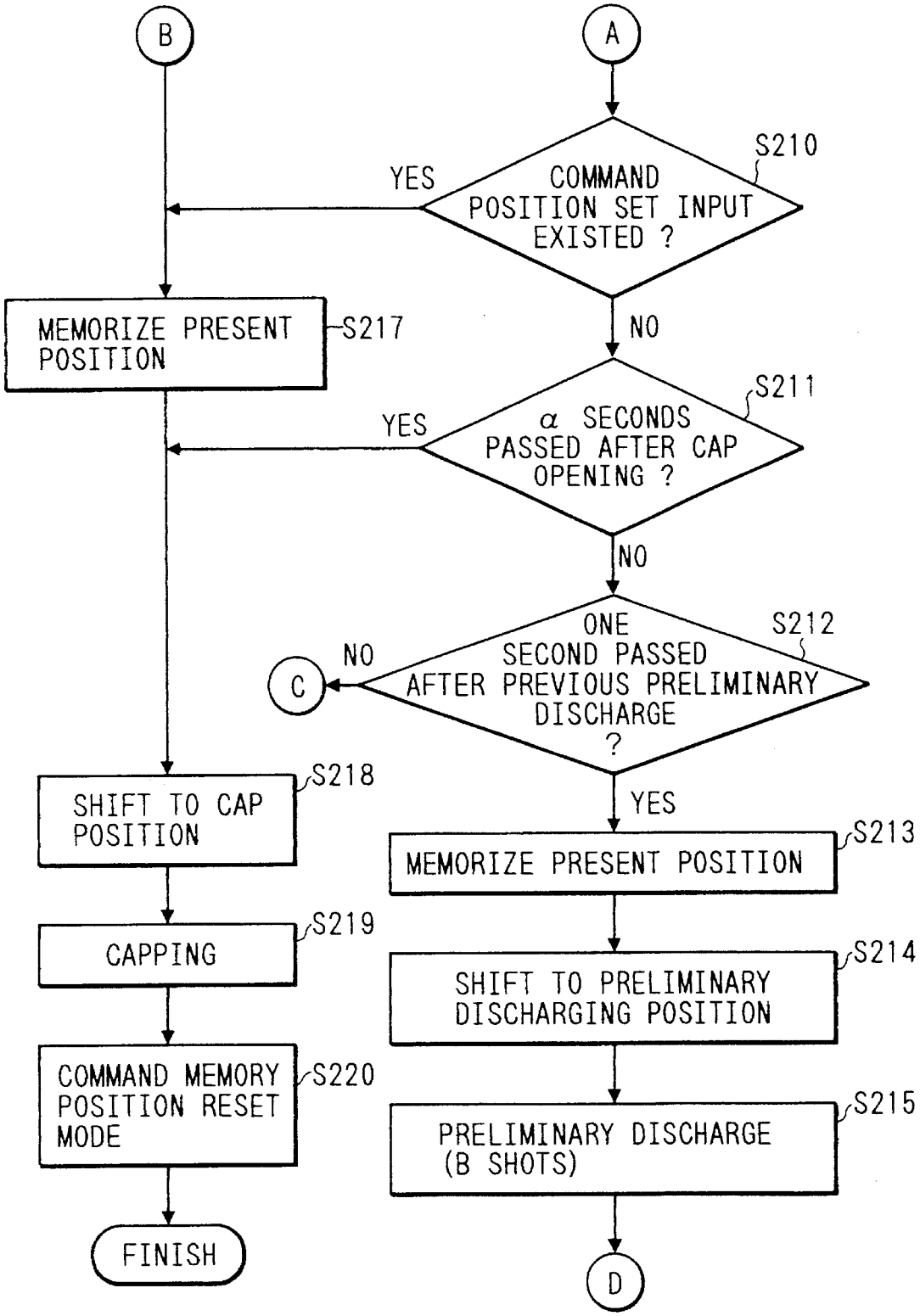

FIGS. 21 and 22 are a timing chart and a flow chart, respectively, showing a control sequence for executing a recording position command mode in the ink jet recording system according to the present invention.

The recording position command mode according to this embodiment is a control sequence executed when the recording is effected regarding a format sheet or a recording sheet on which a partial image was recorded. That is to say,the confirmation and setting of the recording position, and the setting of the recording range (area) are effected while shifting the carriage (and recording head); however, meanwhile, the ink is not discharged. Accordingly, in order to prevent the ink from being more viscous and/or the non-discharge of the ink, a preliminary discharge treatment and a capping treatment are effected. Further, in order to perform these treatments, the treatments such as the setting of the recording position and the like by means of the carriage are interrupted, and, alternatively, the carriage is shifted to a position for permitting the preliminary discharge and the like per a predetermined time period.

Now, the control sequence of the recording position command mode will be explained on the basis of the flow chart of FIG. 22 with reference to the timing chart of FIG. 21.

When the recording position command is given by a predetermined key input, the control sequence according to this embodiment is executed. In a step S201, the cap 51 is opened (timing ① in FIG. 21), and, in a step S202, the carriage 11 is shifted to the command position, for example, in response to the input by a space key (timing ②). Meanwhile, in a step S203, it is judged whether, in consequence of the arrival of the carriage 11 to the command position, the setting of the command position by a predetermined key input exists or not; if negative, in a step S204, it is judged whether a predetermined T seconds after the cap opening has passed or not.

When the T seconds has passed, in a step S205, a present position of the carriage 11 is memorized, and, in a step S206, the carriage 11 is shifted to the preliminary discharging position (timing ③). Further, in a step S207, a predetermined amount of the preliminary discharges (A shots) are effected (timing ④).

Thereafter, in a step S208, the carriage 11 is shifted to the previously memorized position, and, in a step S209, the carriage 11 is shifted to the command position in the same manner as the previous one. Meanwhile, in a step S210, it is judged whether the command position set input exists or not in the same manner as the previous one; if negative, in a step S211, it is judged whether a predetermined $\alpha$ seconds after the position command, i.e., after the start of the control sequence has passed or not. The $\alpha$ seconds normally correspond to a time period during which the setting of the command position should have been finished, and is selected so as not to affect a bad influence upon the ink discharge by not uncapping the recording head.

If the negative is made in step S211, in a step S212, it is judged whether a predetermined t seconds after the previous preliminary discharge has passed or not; if affirmative, the sequence is subjected to treatments in steps S213 and S214 similar to the above, and, in a step S215, the preliminary discharges (B shots) are effected, and then, the sequence returns to the step S208.

If the command position set input exists in the step S203 or S210, the present position is memorized in a step S216 or S217, respectively, and, if it is judged that the α seconds have passed in the step S211, the sequence goes to a step S218.

In the step S218, the carriage 11 is shifted to the cap position (timing ⑤), and in a step S219, the capping is effected (timing ⑥), and, in a step S220, the command mode is reset, thus finishing this control sequence.

Incidentally, the above-mentioned time periods T, t, α (seconds) can be set, for example, in accordance with the temperature and/or humidity in the atmosphere, or may be automatically set, by providing corresponding sensors, on the basis of the detected results of the sensors.

The shifting of the carriage to the command position in the above-mentioned control sequence is performed by pushing the space key by the operator. In this case, by utilizing the marker 49 formed on the carriage 11 and the scale 47 formed on the hold-down plate as shown in FIG. 2, the operator can know the position of the carriage and accordingly the position of the discharge openings with respect to the recording sheet. Incidentally, although the position of the marker 49 is offset from the position of the discharge openings, an amount of such offset is previously memorized, and thus, an automatic correction regarding this offset is effected during the recording operation and the like. Since the scale 47 is provided on a member inherent to the ink jet recording system such as the hold-down plate 45, it is possible to use the scale 47 near the recording sheet to position the latter.

Further, similarly, in the operation regarding the shifting to the command position, by using the marker 17 provided on the operating lever 15 as shown in FIG. 2 and a scale (not shown) formed on the window 8 of the cover of the typewriter shown in FIG. 1, particularly, the operator can know the shifting amount of the carriage 11.

In this way, the marker 49, 17 and the associated arrangement are especially effective in a case when the carriage is returned to a position where it existed at the interruption, after the position confirming operation due to the shift of the carriage is interrupted for performing the preliminary discharge in the ink jet recording system.

Figure 23:
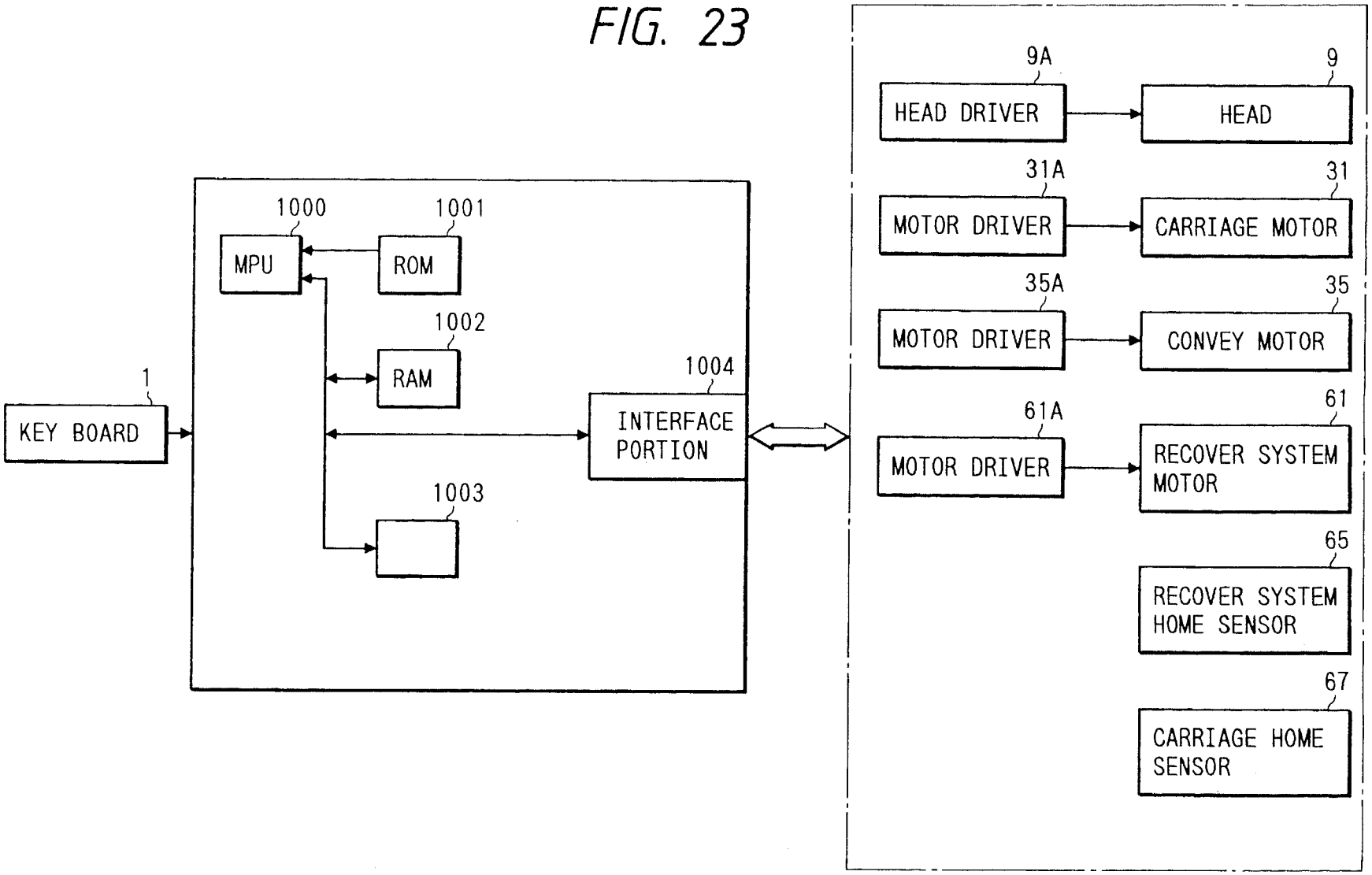
FIG. 23 is a block diagram of a control mechanism for the recording position command mode.

FIG. 23 is a block diagram for carrying out the control sequence as shown in FIGS. 22 and 23.

The cap position and the shift position of the carriage 11 can be known on the detected results from a recover system home sensor 65 and a carriage home sensor 67. Further, the shift to the command position and the command position set input are performed by using the space key and predetermined keys. Incidentally, in FIG. 23, the reference numeral 1000 denotes an MPU for carrying out the above-mentioned control sequence; 1001 denotes a ROM for storing a program regarding the control sequence and the like; 1002 denotes a RAM adapted to store the present position of the carriage 11 and used as a work area in executing the control sequence; and 1003 denotes a timer for measuring the time periods such as the above-mentioned T, t, α seconds and the like.

Figure 24:
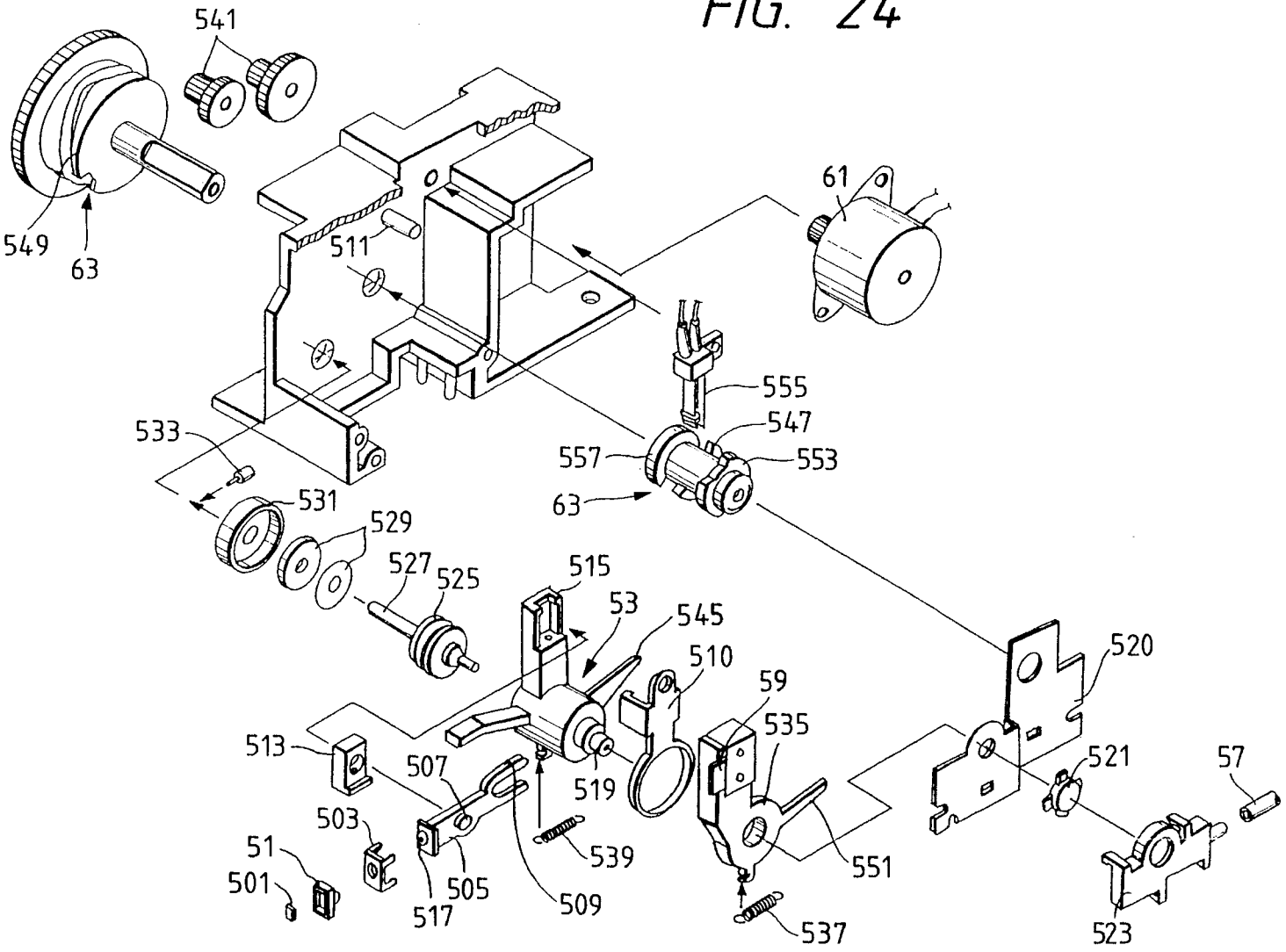
FIG. 24 is an exploded perspective view of a discharge recover mechanism shown in FIG. 2.

FIG. 24 is an exploded perspective view of a main portion of a recover system comprising the cap 51, pump 53, blade 59, motor 61, cam device 63 and the like as shown in FIG. 2.

In FIG. 24, the reference numeral 501 denotes an ink absorber disposed within the cap 51; 503 denotes a holder member for holding the cap 51; and 505 denotes a cap lever mounted for pivotal movement around a pin 507 and adapted to abut the cap 51 against the discharge opening forming surface of the discharge unit **9*a* or to separate the cap from such discharge opening forming surface by a force applied to the pin 507. The reference numeral 511 denotes a pin for regulating the range of the pivotal movement of the cap lever 505 by engaging with an end 509 of the cap lever 505**.

The reference numeral 513 denotes a jig having a hole into which the pin 507 of the cap lever 505 is fitted and used for attaching the cap lever 505 to a supporting portion 515 formed on the pump 53. The reference numeral 516 denotes a retainer member for maintaining the attached condition between the cap lever and the pump; and 517 denotes an operating portion applying a force to the cap 51 to abut the latter against the discharge opening forming surface, which operating portion urges the back surface of the cap at its central portion. The operating portion 517 has an introduction port 517A (FIG. 25) for the sucked ink, and ink passages are formed in the cap lever 505, pin 507, jig 513 and the supporting portion 515, respectively. When the pump 53 generates a suction force, the ink is introduced into the pump 53 through these ink passages.

The reference numeral 519 denotes a hollow shaft protruding from a central portion of an end surface of the pump 53 and having an ink passage therein, which shaft is rotatably mounted on a side wall portion 520. Thus, the rotation force of the pump 53 itself is applied to the cap lever 505 through the supporting portion 515, thereby advancing and retracting the cap 51. The reference numeral 521 is a passage forming member connected to the pump shaft 519; and 523 denotes an attachment member for the tube 57. That is to say, ink passages are formed in the shaft 519, passage forming member 521 and attachment member 523, and the ink sucked by the pump 53 is discharged into the waste tank 55 through these ink passages and the tube 57.

The reference numeral 525 denotes a piston of the pump 53; 527 denotes a piston shaft; 529 denotes packings; and 531 denotes a cap for the pump 53. The reference numeral 533 denotes a pin attached to the piston shaft 527 and subjected to a force for activating the piston 525.

The reference numeral 535 denotes a blade lever to which the blade 59 is attached and which is supported by the pump shaft 519 for pivotal movement to advance or retract the blade 59 with respect to the recording head. The reference numeral 537 denotes a spring for applying a rotational force to the blade lever 535 to advance the blade 59; and 539 denotes a spring for applying a rotational force to the pump 53 so that the cap 53 is biased toward the recording head.

The reference numeral 541 denotes a gear train for transmitting the rotation of the motor 61 to the cam device 63. The cam device 63 includes a cam 547 engaging by an engagement portion 545 formed on the pump 53 to rotate the latter, a cam 549 engaging by the pin 533 attached to the piston shaft 527 of the pump 53 to activate the pump, a cam 553 engaging by an engagement portion 551 formed on the blade lever 535 to rotate the latter, and a cam 557 engaging by a switch 555 for detecting the home position of the cam device 63. The operation of these cams will be described later.

Figure 25:
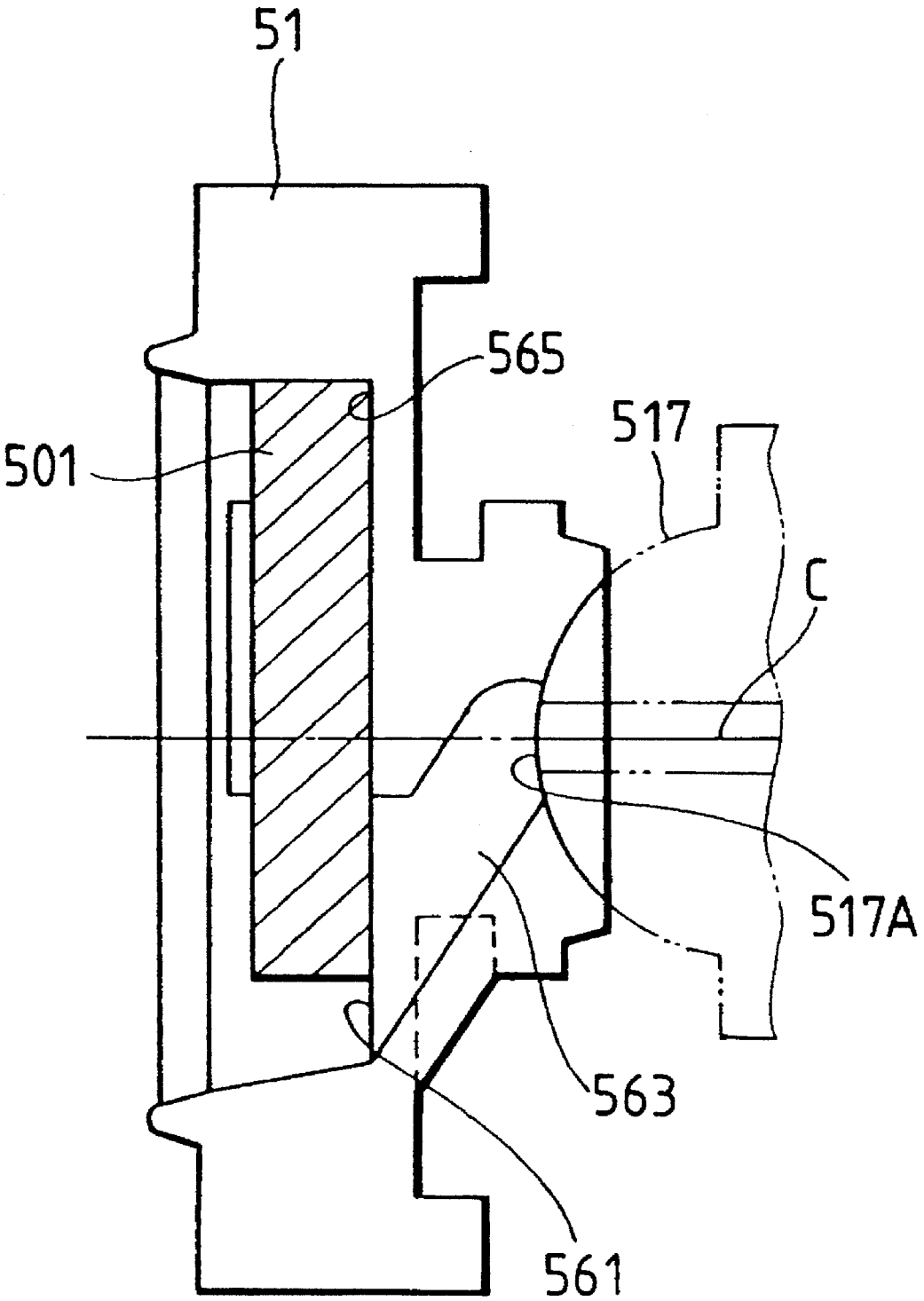
FIG. 25 is a side sectional view of a cap portion of the discharge recover mechanism.

FIG. 25 shows an example of the construction of the cap 51 and the like.

In this example, an ink suction opening 561 is open to a lower portion of the cap, and an ink passage 563 connecting between the ink suction opening and the ink introduction port 517A of the operating portion 517 of the cap lever 505 is formed in the cap. Further, the ink suction opening 561 is not completely covered by the ink absorber 501.

In the conventional case, the ink absorber 501 covered the whole surface 565 of the cap 51, the ink passage was formed linearly along a central dot chain line C, and the ink suction opening was open to a central area of the back surface of the ink absorber. With this arrangement, during the discharge recovering treatment, since the ink absorbed in the ink absorber flowed toward the bottom of the ink absorber by its own weight, the non-absorbed ink was solidified at that position, thus worsening the absorbing ability of the ink absorber and/or reducing the suction force.

To the contrary, in the illustrated example, even if the ink flows downwardly by its own weight, since the ink is sucked from the ink suction opening 561 formed in the lower portion of the cap, an amount of ink remaining in the ink absorber 501 is remarkably reduced, thus greatly postponing the deterioration of the ink absorber due to the solidification of ink, whereby the service lives of the ink absorber and the cap 51 attached thereto can be lengthened.

Incidentally, in this example, while the ink passage 563 in the cap 51 was formed as shown, since the ink passage is formed in the cap lever, if a discrete ink suction passage is additionally provided, it is not necessary that the ink passage in the cap is not formed as shown. That is to say, so long as the ink suction opening 561 is formed in the lower portion of the cap 51, the ink passage may have any configuration.

Figure 26:
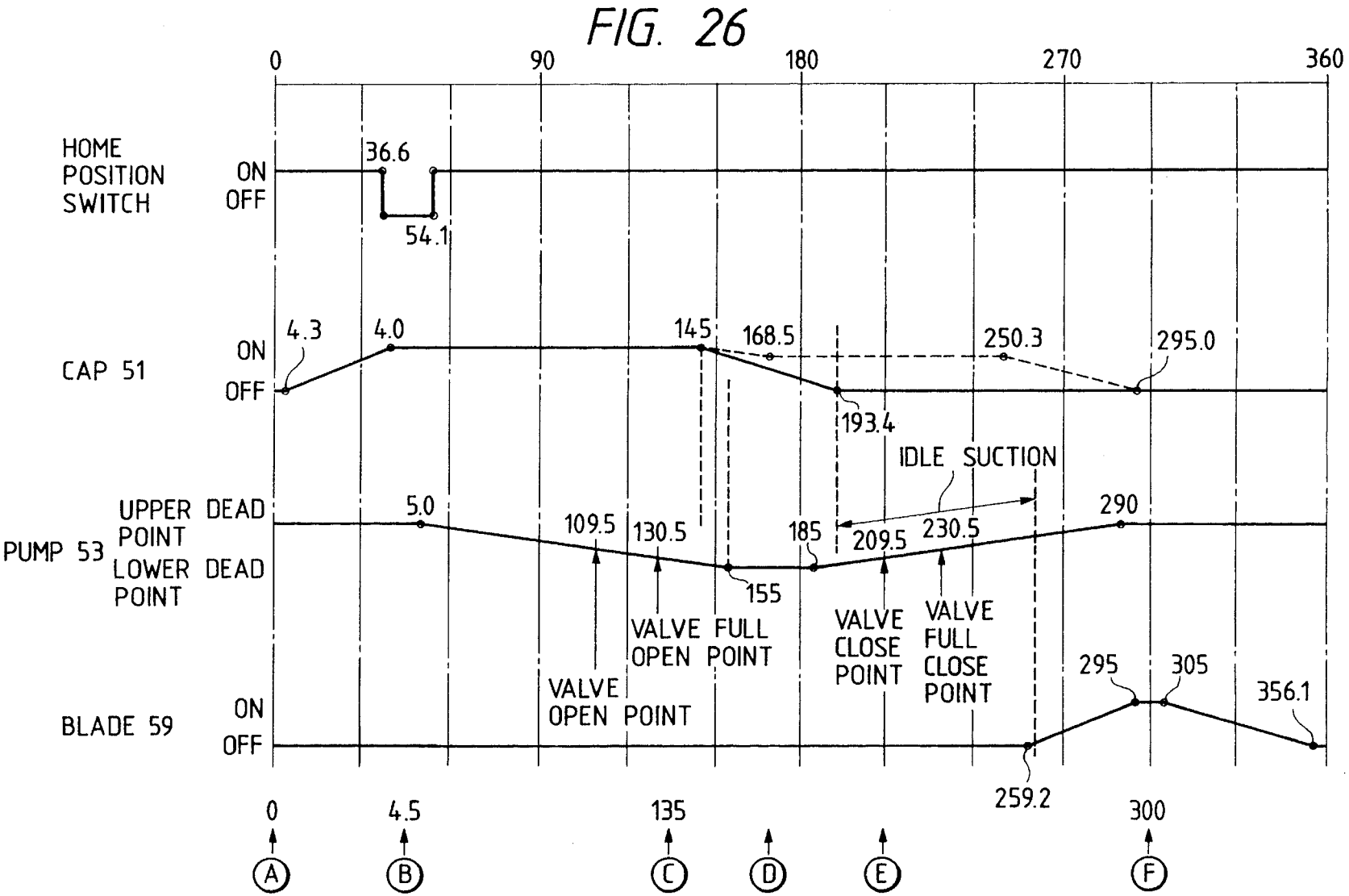
FIG. 26 is a timing chart showing a series of recover operations in the discharge recover mechanism.
Figure 27:
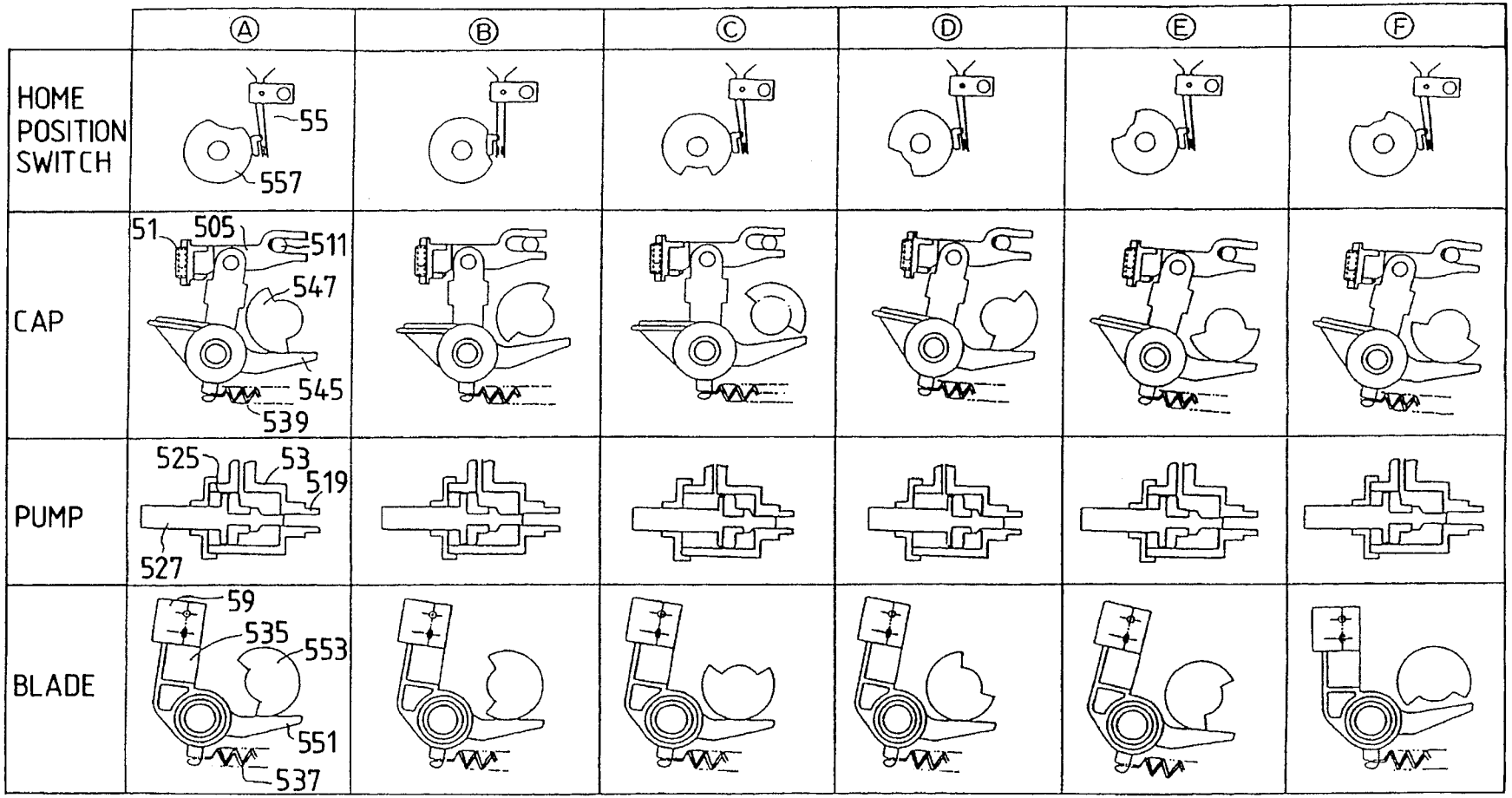
FIG. 27 is a view showing the operations of various elements in the discharge recover operation in various time points.

FIGS. 26 and 27 are explanatory views showing operating positions of various elements corresponding to cam profiles and cam positions of various cams in the cam device 63. Incidentally, the numerical values shown in FIG. 26 designate rotation angles of the cams.

In FIGS. 26 and 27, a Ⓐ shows cam positions and conditions of various elements at the start of the recording operation, where the cap 51 and the blade 59 are separated from the discharge opening forming surface of the recording head, and the pump 53 is in its upper dead point. A Ⓑ shows a position where the home position switch 55 is turned OFF, which position is referred to as a home position of the cam device 63. This position is a position set in the waiting time period of the recording and the like; in this case, the cap 51 covers the discharge opening forming surface, the blade 59 is retracted and the pump 53 is in its upper dead point.

As the cams are rotated from the position shown by the Ⓑ, the piston 525 is shifted toward its lower dead point while maintaining the engagement between the cap 51 and the discharge opening forming surface (cap on), thus increasing the negative pressure in the suction system communicating with the cap. Thereafter, the piston 525 reaches the ink introduction opening of the pump. After the time period when the ink introduction opening is closed (valve closing time period) has elapsed, the valve starts to open (point of 109.5°), and then the valve is completely opened (point of 130.5°); thereafter, the piston 525 reaches a position shown by a Ⓒ near the lower dead point.

In consideration of the fluid resistance in the ink suction system, by stopping the rotation of the cams by a predetermined time period in this position, an adequate suction of the ink is effected; thereafter, as the cams are rotated again, the piston 525 reaches the lower dead point, and the cap 51 starts to be separated from the discharge opening forming surface. This position shown by a Ⓓ is maintained for a predetermined time period.

Thereafter, as the cams are still rotated, the piston 525 starts to be shifted toward the upper dead point again. In this stroke, the valve starts to be closed (point of 209.5°), and then is completely closed (point of 230.5°); on the other hand, in a position shown by a Ⓔ, the cap 51 is completely separated from the discharge opening forming surface. In the vicinity of this position, by activating the piston 525 several times, the ink remaining in the ink suction system is sucked toward the pump (idle suction).

Incidentally, left and right chambers in the pump on both sides of the piston 525 are communicated with each other through an appropriate fluid passage (not shown). The fluid passage is closed when the piston is shifted from the upper dead point to the lower dead point and is opened when the piston is shifted from the lower dead point to the upper dead point. Further, the right chamber disposed at the right of the piston is communicated with the ink passage formed in the pump shaft 519. Accordingly, during the idle suction, when the piston 525 is shifted from the lower dead point to the upper dead point, the ink introduced into the left chamber is transferred into the right chamber; whereas, when the piston is shifted from the upper dead point to the lower dead point, the ink is introduced from the ink suction system to the left chamber and is discharged from the right chamber to the waste ink tank.

Thereafter, when the cams are still rotated normally, the blade 59 protrudes to reach a wiping permissible condition (position shown by a Ⓕ). In this condition, as the carriage 11 is shifted toward the recording area, the blade 59 is engaged by the discharge opening forming surface of the head to wipe this surface, thus removing the ink from such surface. Then, by further rotating the cams, the blade 59 is retracted, thus setting the cams in the position shown by the Ⓐ. In this condition, the carriage 11 is shifted toward the cap to face the discharge opening forming surface of the head to the cap 51; thereafter, the cams are shifted to the position shown by the Ⓑ to effect the cap-on, and then are stopped.

Incidentally, when it is desired to perform the recording operation again, the cams are rotated normally or reversely from the position shown by the Ⓑ, thus protruding the blade 59 to effect the wiping; thereafter, the recording operation may be started.

Figure 28:
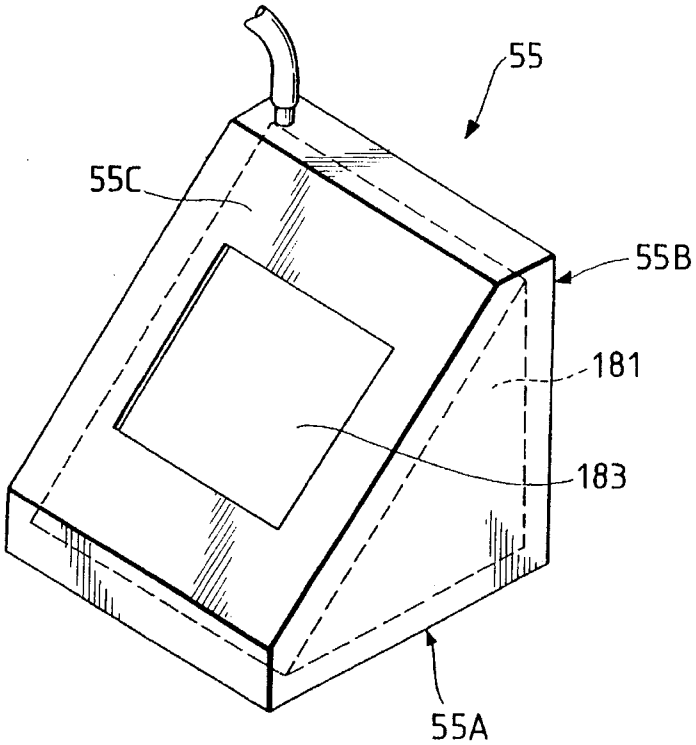
FIG. 28 is a schematic perspective view of a waste ink tank for reserving ink discharged by the discharge recover operation.

FIG. 28 shows an example of the waste ink tank 55 in its used condition.

The reference numeral 181 denotes an ink absorber for holding the waste ink; 55A denotes a portion which becomes a bottom surface when the typewriter is used (in the condition as shown in FIG. 1A); and 55B denotes a portion which becomes a bottom surface when the typewriter is folded as shown in FIG. 1B and the operator transports the typewriter by gripping the grip 7. The reference numeral 55C denotes an oblique surface which never becomes a bottom surface in any cases, and, in the illustrated embodiment, a vent cloth 183 is disposed on this oblique surface. The vent cloth 183 can pass through the vapor of the ink solvent but does not pass through the liquid ink, and, for example, consists of "vapor road" (registered trade mark of "TEIJIN" Co. Ltd., in Japan).

By installing such vent cloth 183, the leakage of the ink from the waste ink tank can substantially be prevented;

however, in the illustrated embodiment, by arranging such vent cloth on the oblique surface 55C which never becomes a bottom surface in any cases, the leakage of the ink can completely be prevented.

Figure 29A:
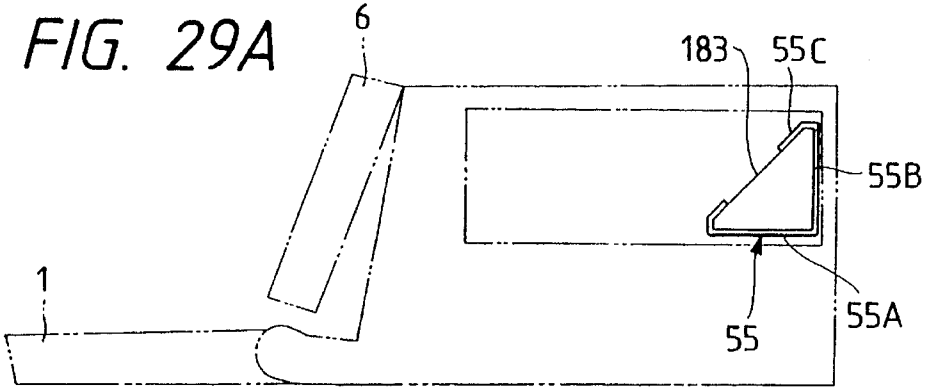
FIGS. 29A and 29B are views showing positions of the waste ink tank in the operational and non-operational configurations, of the printer, respectively.
Figure 29B:
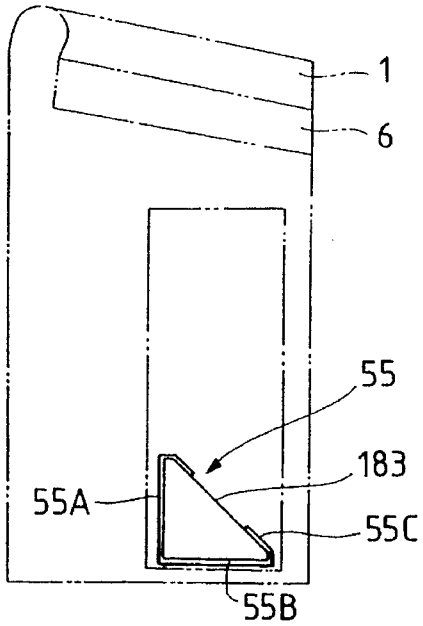

That is to say, as shown in FIGS. 29A and 29B, in the operational condition of the typewriter, the portion 55A becomes the bottom surface and the oblique surface 55C faces upwardly; whereas, in the non-operational condition of the typewriter (in the transportation of the typewriter), the portion 55B becomes the bottom surface and the oblique surface 55C also faces upwardly. Accordingly, the waste ink does not ooze through the vent cloth 183, thus completely preventing the leakage of the ink.

The present invention brings about excellent effects particularly in a recording head, recording device of a bubble jet system among ink jet recording systems.

As to its representative constitution and principle, for example one practiced by use of the basic principle disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleus boiling corresponding to the recording information on an electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. Nos. 4,558,333, 4,459,600 disclosing the constitution having the heat acting portion arranged in the flexed region is also included in the present invention. In addition, the present invention can be also effectively made using the constitution as disclosed in Japanese Patent Laid-Open Application No. 59-123670 which discloses the constitution using a slit common to a plurality of electricity-heat converters as the discharging portion of the electricity-heat converter or Japanese Patent Laid-Open Application No. 59-138461 which discloses the constitution having the opening for absorbing a pressure wave of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device. or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat convertors or another heating element or preliminary heating means according to a combination of these, and it is also effective for performing stable recording to perform a preliminary mode which performs discharging separate from recording.

Further, as the recording mode of the recording device, the present invention is extremely effective for not only the recording mode only of a primary stream color such as black etc., but also a device equipped with at least one of plural different colors or full color by color mixing, whether the recording head may be either integrally constituted or combined in plural number.

What is claimed is:

1. An image forming apparatus comprising:

a main body;

a conveying rotary member for conveying a sheet in a sheet conveying direction;

guide means for guiding a sheet being conveyed along said conveying rotary member;

a second rotary member supported by said guide means and arranged to form a nip between said second rotary member and said conveying rotary member, for nipping a sheet being conveyed therethrough;

biasing means for biasing said guide means to urge said second rotary member against said conveying rotary member;

a supporting member for supporting said guide means to be shiftable between a first position and a second position located upstream of the first position in the sheet conveying direction, such that said guide means is located in the first position when a sheet is nipped and conveyed by said conveying rotary member and said second rotary member, and said guide means is shifted along an outer periphery of said conveying rotary member in a direction reverse to the sheet conveying direction to the second position as a result of a reaction force received from a trailing end of a sheet conveyed by said conveying rotary member when the trailing end passes through the nip; and image forming means for forming an image on the sheet being conveyed by said conveying rotary member, wherein said supporting member includes movement regulating means for limiting movement of said guide means in the sheet conveying direction and the direction reverse to the sheet conveying, and wherein said movement regulating means includes first and second contact portions provided on said guide member, and third and fourth contact portions provided on the main body of the apparatus for limiting movement of said guide means to a predetermined range, said first and third contact portions being arranged for abutting so as to selectively inhibit said guide means from moving beyond the predetermined range in the sheet conveying direction, and said second and fourth contact portions being arranged so as to selectively inhibit said guide means from moving beyond the predetermined range in the direction reverse to the sheet conveying direction.

2. An image forming system according to claim 1, wherein said image forming means comprises an ink jet head for forming image by discharging an ink onto the sheet being conveyed.

3. An image forming system according to claim 2, wherein said ink jet head discharges the ink by thermal energy.

4. A sheet feeding apparatus comprising:

a main body;

a conveying rotary member for conveying a sheet in a sheet conveying direction;

guide means for guiding the sheet being conveyed along said conveying rotary member;

a second rotary member rotatably supported by said guide means and arranged to form a nip between said second rotary member and said conveying rotary member for nipping a sheet being conveyed therethrough;

biasing means for biasing said guide means to urge said second rotary member against said conveying rotary member;

a supporting member for supporting said guide means to be shiftable between a first position and a second position located upstream of the first position in the sheet conveying direction, such that said guide means is located in the first position when a sheet is nipped and conveyed by said conveying rotary member and said second rotary member, and said guide means is shifted along an outer periphery of said conveying rotary member in a direction reverse to the sheet conveying direction as a result of a reaction force received from a trailing end of a sheet conveyed by said conveying rotary member when the trailing end passes through the nip;

wherein said supporting member includes movement regulating means for limiting movement of said guide means in the sheet conveying direction and the direction reverse to the sheet conveying, and wherein said movement regulating means includes first and second contact portions provided on said guide member, and third and fourth contact portions provided on the main body of the apparatus for limiting movement of said guide means to a predetermined range, said first and third contact portions being arranged for abutting so as to selectively inhibit said guide means from moving beyond the predetermined range in the sheet conveying direction, and said second and fourth contact portions being arranged for abutting so as to selectively inhibit said guide means from moving beyond the predetermined range in the direction reverse to the sheet conveying direction.

5. A sheet feeding apparatus according to claim 4, further including a separating means for separating said second rotary member from said conveying rotary member.

6. A sheet feeding apparatus according to claim 4, wherein said conveying rotary member comprises a roller.

7. A sheet feeding apparatus according to claim 4, further comprising a gear train for transmitting a drive force to said conveying rotary member.

* * * * *

UNITED STATES PATENT AND TRADEMARK OFFICE

CERTIFICATE OF CORRECTION

PATENT NO. : 5,558,451

DATED : September 24, 1996

INVENTOR(S) : Hanabusa et al.

It is certified that error appears in the above-indentified patent and that said Letters Patent is hereby corrected as shown below:

COLUMN 24:

Line 7, "device ." should read --device.,--

COLUMN 25:

Line 12, "forming" should read --forming an--; delete "an".

Signed and Sealed this

Twenty-ninth Day of April, 1997

*Attest:*

Bruce Lehman

BRUCE LEHMAN

*Attesting Officer*

*Commissioner of Patents and Trademarks*